US007066781B2

(12) United States Patent
Weston

(10) Patent No.: US 7,066,781 B2
(45) Date of Patent: Jun. 27, 2006

(54) CHILDREN'S TOY WITH WIRELESS TAG/ TRANSPONDER

(76) Inventor: Denise Chapman Weston, 195 Walden Way, Wakefield, RI (US) 02879

( * ) Notice: Subject to any disclaimer, the term of this patent is extended or adjusted under 35 U.S.C. 154(b) by 193 days.

(21) Appl. No.: 10/045,582

(22) Filed: Oct. 22, 2001

(65) Prior Publication Data

US 2002/0193047 A1 Dec. 19, 2002

Related U.S. Application Data

(60) Provisional application No. 60/241,893, filed on Oct. 20, 2000.

(51) Int. Cl.
*A63F 9/24* (2006.01)

(52) U.S. Cl. ..... 446/268; 446/484

(58) Field of Classification Search ..... 446/268, 446/297, 298, 299, 300, 301, 302, 369, 484
See application file for complete search history.

(56) References Cited

U.S. PATENT DOCUMENTS

| | | | | |
|---|---|---|---|---|
| 5,651,049 A | | 7/1997 | Easterling et al. | |
| 5,786,626 A | * | 7/1998 | Brady et al. | 257/673 |
| 5,810,666 A | | 9/1998 | Mero et al. | |
| 5,944,533 A | | 8/1999 | Wood | |
| 6,012,984 A | | 1/2000 | Roseman | |
| 6,196,893 B1 | | 3/2001 | Casola et al. | |
| 6,330,427 B1 | | 12/2001 | Tabachnik | |
| 6,463,257 B1 | | 10/2002 | Wood | |
| 6,482,067 B1 | | 11/2002 | Pickens | |
| 6,494,457 B1 | | 12/2002 | Conte et al. | |
| 6,509,217 B1 | * | 1/2003 | Reddy | 438/153 |
| 6,525,660 B1 | * | 2/2003 | Surintrspanont | 340/572.1 |

FOREIGN PATENT DOCUMENTS

| | | | |
|---|---|---|---|
| WO | WO 02/47013 | * | 6/2002 |
| WO | WO 02/47013 A2 | * | 6/2002 |
| WO | WO 03/043709 | * | 5/2003 |

OTHER PUBLICATIONS

Can et al. US 2002/0038267A1 Mar. 28, 2002.*
"Raise High The 3D Roof Beam" *Business Week Lifestyle* Nov. 2001.
"Tech Designers Rethink Toys: Make Them Fun" *Wall Street Journal* Dec. 2001.

* cited by examiner

*Primary Examiner*—Jacob K. Ackun, Jr.

(57) ABSTRACT

A playmate toy or similar children's toy is provided having associated wireless, batteryless ID tag that can be read from and/or written to using a radio-frequency communication protocol. The tag is mounted internally within a cavity of the toy and thereby provides wireless communication of stored information without requiring removal and reinsertion of the tag. In this manner, a stuffed animal or other toy can be quickly and easily identified non-invasively, without damaging the toy. Additional information (e.g., unique personality traits, special powers, skill levels, etc.) can also be stored on the ID tag, thus providing further personality enhancement, input/output programming, simulated intelligence and/or interactive gaming possibilities.

20 Claims, 20 Drawing Sheets

CHILDREN'S TOY WITH WIRELESS TAG/ TRANSPONDER

RELATED APPLICATIONS

This application claims priority to U.S. provisional application Ser. No. 60/241,893, filed Oct. 20, 2000, and incorporated herein by reference in its entirety.

BACKGROUND OF THE INVENTION

1. Field of the Invention

This invention relates in general to children's'toys primarily of the stuffed-animal, doll or action figure variety, and, in particular, to a children's toy having an RFID tag or other wireless, batteryless communication/identification device associated therewith.

2. Description of the Related Art

Children's toys in the form of traditional dolls, puppets, stuffed animals and the like have been around for centuries and are an enduring favorite among children—particularly among toddler-age children. A favorite doll, stuffed animal or other similar toy can provide a much-needed imaginary friend, pet or playmate for a child who occasionally gets lonely or bored. Such "playmate" toys can also help a child to express himself or herself and to learn basic social skills that foster personality development and overall social adjustment.

Most traditional playmate toys are simple stuffed animals, puppets or molded plastic dolls and the like. Most are mass produced and distributed nationally and/or internationally via a vast network of stores, wholesalers, retailers and other distributors. Many of these toys embody, represent or are otherwise associated with a particular licensed television character or personality, such as the Sesame Street™ puppets, Barney and Friends™, or the various Disney™ characters. Thus, the familiarity and likeability of the licensed character creates demand for the licensed toy. Others are simple generic forms representing people, animals, cars, robots, friendly monsters, and/or other imaginative creations.

Some playmate toys are personalized via individual names, birth certificates, etc. For example, the once-popular Cabbage Patch Kids™ came complete with individualized facial and hair features, name and official birth certificate. Another popular toy vendor, Build a'Bear™, takes the concept of personalization even further by allowing and encouraging children to actually pick out, stuff, dress and name their favorite stuffed-animal playmate toy. In many cases, the vendor/retailer continues to provides periodic birthday reminder cards, custom wardrobe selections, notices of special events and the like even after the toy is purchased. All of these individualized "personality" touches can make an otherwise-inanimate playmate toy seem more real and fun for a child and helps foster that certain special relationship and bond that often develops between a child and his or her favorite playmate toy.

Another recent improvement involves uniquely identifying a stuffed animal toy with a bar-code tag that is inserted into the stuffing of the toy and which can be "surgically" extracted and read using conventional bar-code technology. The internal bar code tag is useful in helping identify lost or stolen stuffed animals and to return them to their rightful owners. However, use of an internal bar code tag in this manner is inconvenient and can potentially damage the stuffed animal during surgical extraction and replacement. On the other hand, placing the bar code tag on an accessible exterior portion of the stuffed animal could impair the aesthetics and functionality of the toy, possibly posing choking hazards and/or increasing the risk that the tag becomes separated from the stuffed animal.

SUMMARY OF THE INVENTION

The present invention expands and improves upon the concept of a playmate toy or other similar children's toy by associating with the toy a unique wireless, batteryless ID tag ("tag" or "token") that can be read from and/or written to using radio-frequency waves. Because radio waves can easily penetrate solid objects, such as the outer skin of a toy and/or the like, the tag can be mounted internally within a cavity of the toy and thereby provide communication of stored information without requiring surgical removal of the tag. Thus, a stuffed animal or other toy can be quickly and easily identified non-invasively, without damaging the toy. Additional information (e.g., unique personality traits, special powers, skill levels, etc.) can also be easily stored on the tag, thus providing further personality enhancement, input/output programming, simulated intelligence and/or interactive gaming possibilities.

In accordance with one embodiment, the present invention provides a children's toy comprising a doll, puppet or stuffed animal containing therein a wireless tag/transponder configured and adapted to facilitating non-invasive electronic storage and retrieval of desired information.

In accordance with another embodiment the present invention provides an interactive play system and seemingly magical toy for enabling a trained user to electronically send and receive information to and from other toys and/or to and from various reader devices distributed throughout a play facility and/or connected to a master control system. The toy or other seemingly magical object is configured to use a send/receive radio frequency communication protocol which provides a basic foundation for a complex, interactive entertainment system to create a seemingly magic interactive play experience for play participants who possess and learn to use the magical toy.

In accordance with another embodiment the present invention provides an interactive play structure in the theme of a "magic" training center. Within the play structure, play participants train a magical bear and/or learn to use a "magic wand" and/or other tracking/actuation device. The bear or wand allows play participants to electronically and "magically" interact with their surrounding play environment simply by placing the bear or wand in a particular location to produce desired effects within the play environment. Various receivers or transceivers are distributed throughout the play structure to facilitate such interaction via wireless communications.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF DRAWINGS

Having thus summarized the general nature of the invention and its essential features and advantages, certain preferred embodiments and modifications thereof will become apparent to those skilled in the art from the detailed description herein having reference to the figures that follow, of which.

DETAILED DESCRIPTION OF THE PREFERRED EMBODIMENTS

Figure 1:
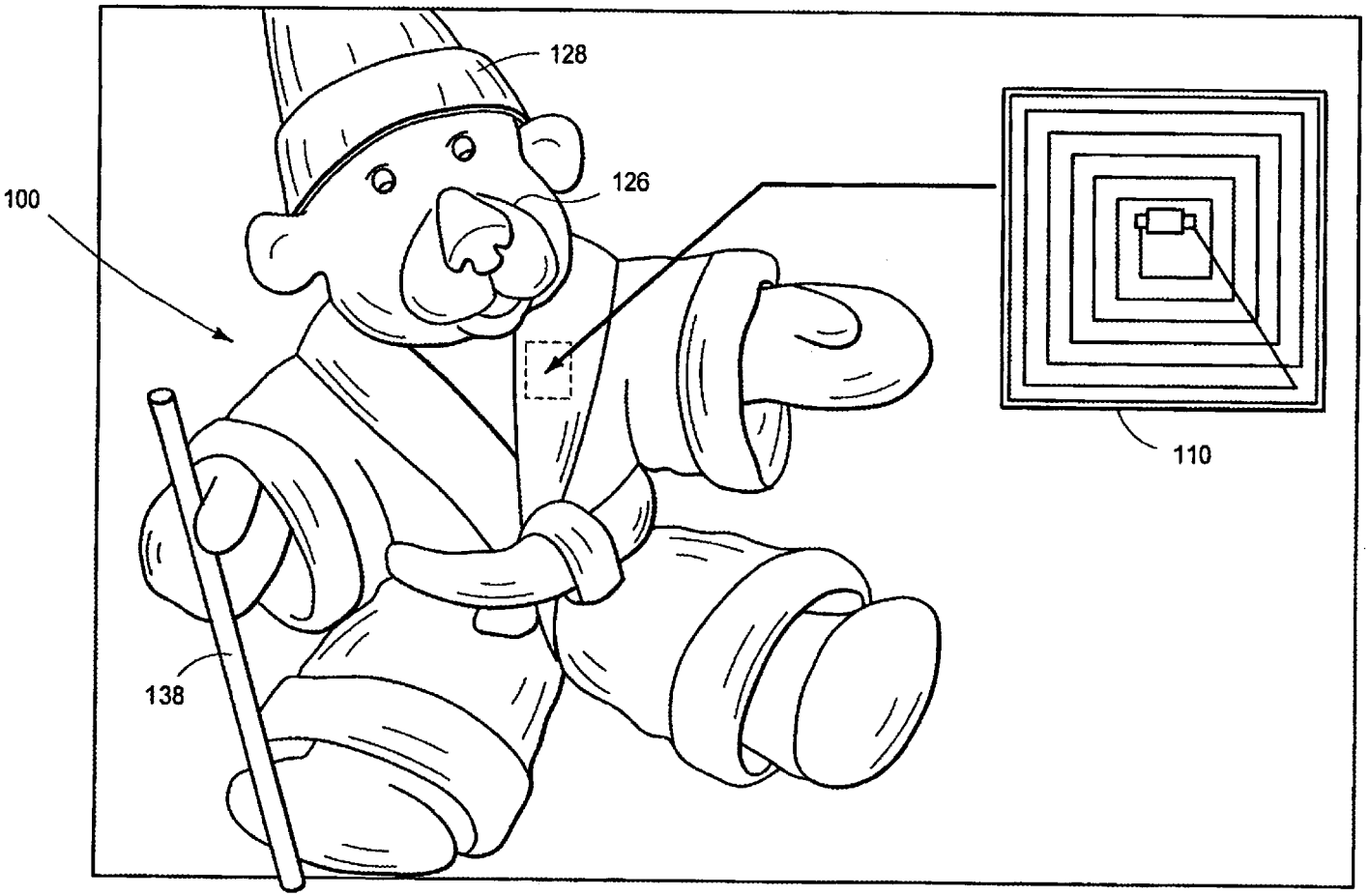
FIG. 1 is a partially-exploded schematic view of a children's toy in the form of a stuffed-animal having an RFID tag device associated therewith in accordance with one preferred embodiment of the invention.

In describing the various preferred embodiments in reference to the appended figures, similar reference numerals may sometimes be used to indicate similar structures or features of the invention. However, it is to be understood that such indicated structures or features may or may not be identical in the various described embodiments of the invention.

RFID-Tagged Toy

FIG. 1 is a partially-exploded schematic view of a children's toy 100 having an RFID tag device 110 associated therewith in accordance with one preferred embodiment of the invention. In the illustrated embodiment the toy comprises a simple stuffed "teddy bear." Of course those skilled in the art will readily appreciate that the invention is equally applicable to many other types of toys, such as, for example and without limitation: stuffed animals, dolls, puppets, action figures, robots, battery operated toys, trinkets, amusement items, jewelry, board games and board game tokens, masks, costumes, magic wands/hats/bags and the like, interactive children's books, balls, pillows, bean bags, and many other similar toys capable of carrying and/or receiving an RFID tag as described herein. Other than as described herein, the bear 100 is fabricated and constructed in any conventional fashion using known and existing materials, fabrics, stuffing and the other materials, as desired.

At least one electronic tag device—preferably a read/write, wireless, batteryless, RFID tag device 110—is inserted inside the body 126 of the bear 100, as illustrated, to create a "magic bear" toy having features and advantages of the present invention. Preferably, insertion of the tag is accomplished during manufacture of the bear at the factory or within a retail facility, in the case of a make-your-own-bear. Alternatively, the tag may be inserted into an existing stuffed-animal or other toy by surgical insertion, partial disassembly or other expedients readily apparent to those skilled in the art.

Figure 10:
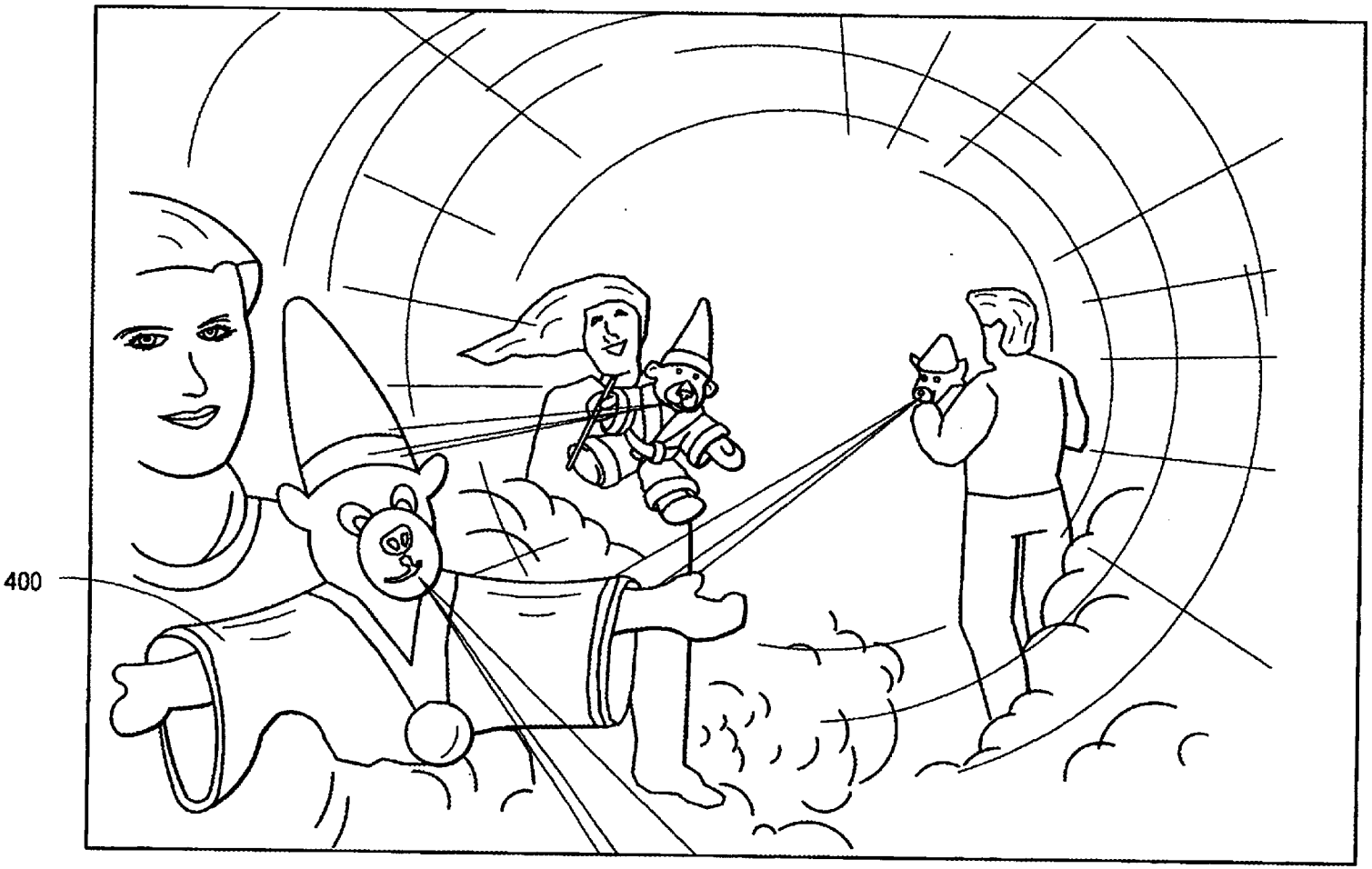

If desired, the tag may be enveloped, contained or otherwise embodied in a small heart-shaped trinket, case or other similar-shaped item as may be appropriate and fun for kids. Preferably, the tag 110 is permanently installed and contained within the body 126 of the bear such that it cannot be easily removed or become dislodged. Placement of the tag within the body 126 is preferably such that it does not interfere with or diminish the softness of the bear or expose sharp/hard surfaces that may poke or puncture the skin of the bear 100. The head and belly are preferred tag locations. Alternatively, multiple tags 110 may be inserted and placed with the body of the bear 100 at one or more different locations (e.g., hands, feet, head, belly, etc.) as desired in order to provide redundant and/or multi-functioning tag devices. Various auxiliary devices, special effects and the like may also be provided to complement the overall theme and functionality of the toy 100. For example, the bear 100 may include an LED indicator on its nose (see FIG. 10) which glows whenever the bear becomes "magically empowered" (i.e., when its tag is read and/or the bear comes within proximity of an associated reader).

The particular tag device 110 illustrated is intended to be inserted inside a children's toy 100. Alternatively and/or in addition, one or more RFID tag devices may be affixed or adhered to the toy bear 100 upon any convenient surface thereof, or it may be inserted into one or more associated articles of clothing, accessories, jewelry or other items designed to be worn/used either by the playmate toy or a child. For example, a "magic" hat 128, or wand 138 may be donned by the bear 100 for purposes of special "magic training" sessions.

Figure 2C:
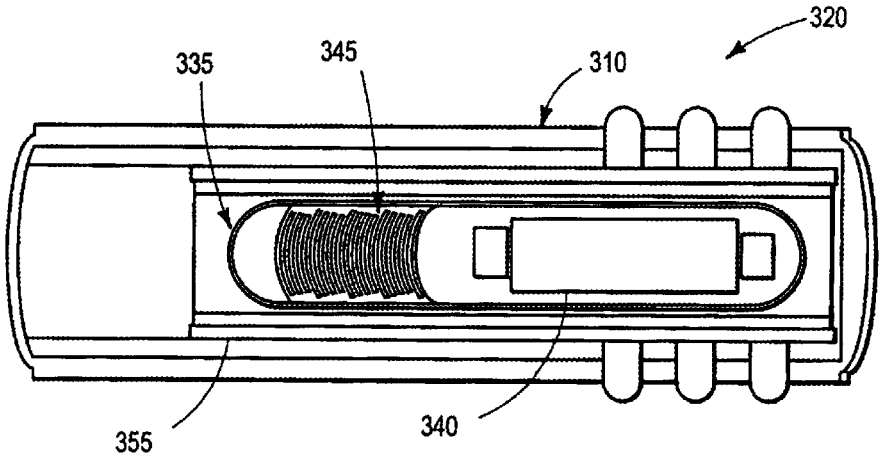
FIG. 2C is a partial cross-section detail view of the distal end or transmitting portion of the wand toy of FIG. 2A, illustrating the provision of an RFID tag device therein.
Figure 2A:
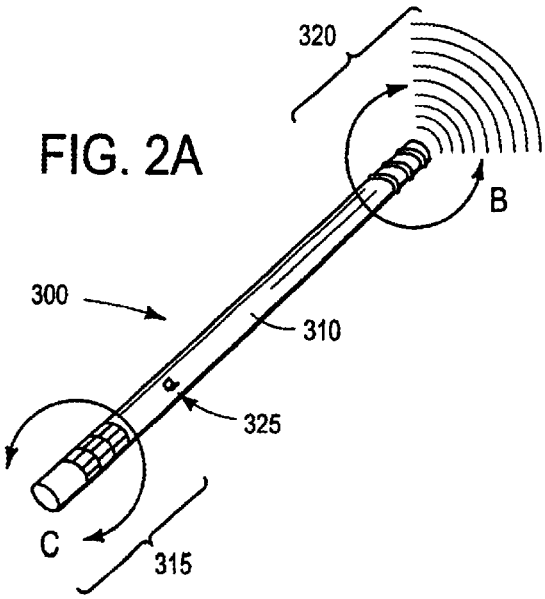
FIG. 2A is a perspective view of a children's toy in the form of a magical wand having an RFID tag device associated therewith in accordance with one preferred embodiment of the invention.

FIG. 2 illustrates in more detail the basic construction of a preferred embodiment of one such "magic" wand 300 having features and advantages in accordance with one preferred embodiment of the invention. As illustrated in FIG. 2A the wand 300 basically comprises an elongated hollow pipe or tube 310 having a proximal end or handle portion 315 and a distal end or transmitting portion 320. If desired, an internal cavity may be provided to receive one or more batteries to power optional lighting, laser or sound effects and/or to power longer-range transmissions such as via an infrared LED transmitter device or RF transmitter device. An optional button 325 may also be provided, if desired, to enable particular desired functions, such as sound or lighting effects or longer-range transmissions.

Figure 2B:
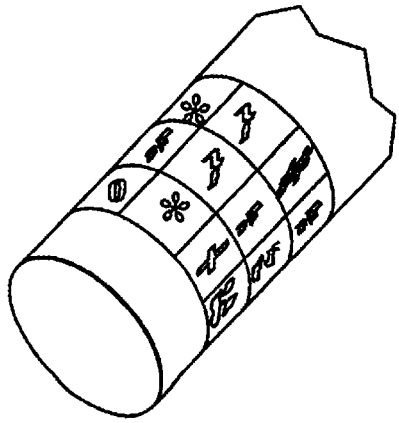
FIG. 2B is a partially exploded detail view of the proximal end or handle portion of the wand toy of FIG. 2A, illustrating the optional provision of combination wheels having features and advantages in accordance with the present invention.

FIG. 2B is a partially exploded detail view of the proximal end 315 of the magic wand toy 300 of FIG. 2A. As illustrated, the handle portion 315 is fitted with optional combination wheels having various symbols and/or images thereon. Preferably, certain wand functions may require that these wheels be rotated to produce a predetermined pattern of symbols such as three owls, or an owl, a broom and a moon symbol. Those skilled in the art will readily appreciate that the combination wheels may be configured to actuate electrical contacts and/or other circuitry within the wand 300 in order to provide the desired functionality. Alternatively, the combinations wheels may provide a simple security measure to prevent unauthorized users from actuating the wand.

RFID Tag/Transponder

FIG. 2C is a partial cross-section detail view of the distal end of magic wand toy 300 of FIG. 2A. As illustrated, the distal end 320 is fitted with an RFID (radio frequency identification device) transponder 335 that is operable to provide relatively short-range RF communications (<60 cm). This transponder basically comprises a passive (non-battery-operated) RF transmitter/receiver chip 340 and an antenna 345 provided within an hermetically sealed vial 350. A protective silicon sheathing 355 is preferably inserted around the sealed vial 350 between the vial and the inner wall of the tube 310 to insulate the transponder from shock and vibration.

At its most basic level, RFID provides a wireless link to uniquely identify objects or people. It is sometimes called dedicated short range communication (DSRC). RFID systems include electronic devices called transponders or tags, and reader electronics to communicate with the tags. These systems communicate via radio signals that carry data either unidirectionally (read only) or, more preferably, bi-directionally (read/write). One suitable RFID transponder is the 134.2 kHz/123.2 kHz, 23 mm Glass Transponder available from Texas Instruments, Inc. (http://www.tiris.com, Product No. RI-TRP-WRHP).

Figure 3:
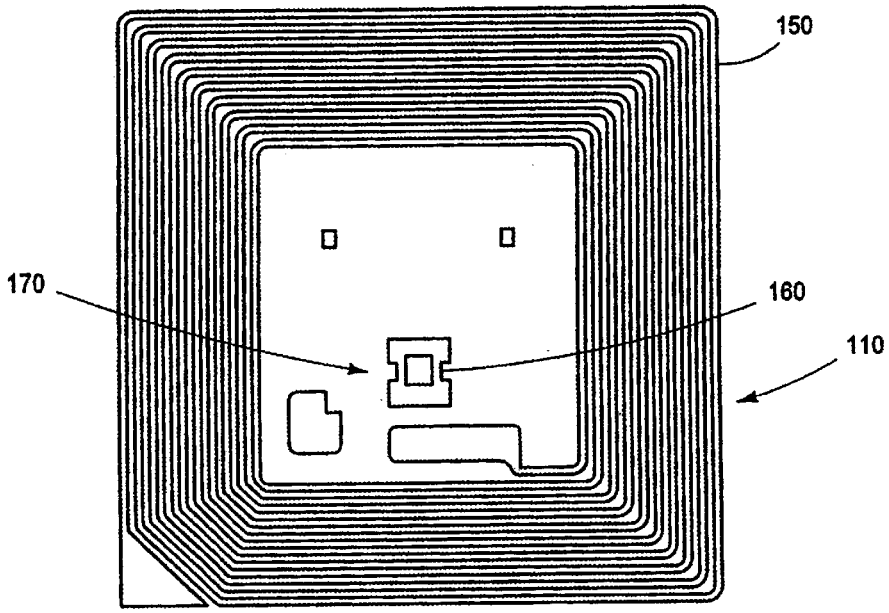
FIG. 3 is a detailed schematic view of one embodiment of an RFID tag device for use with the toy of FIG. 1 and having features and advantages in accordance with the present invention.

FIG. 3 is a detailed schematic view of an alternative embodiment of an RFID tag device 110 for use with the toy bear of FIG. 1. The tag 110 in the preferred embodiment illustrated preferably comprises a radio frequency tag pre-programmed with a unique bear identifier number ("UBIN"). Other stored information (either pre-programmed or programmed later) may include, for example, the bear's name, its owner's name and age, the bear's rank or level, total points accumulated, tasks completed, facilities visited, etc. The tag 110 generally comprises a spiral wound antenna 150, a radio frequency transmitter chip 160 and various electrical leads and terminals 170 connecting the chip 160 to the antenna 150.

The tag may be a passive tag 110 or battery-powered, as expedience and costs dictate. Preferably, the tag 110 is passive (requires no batteries) so that it is inexpensive to purchase and maintain. Such tags and various associated readers and other accessories are commercially available in a wide variety of configurations, sizes and read ranges. RFID tags having a read range of between about 10 cm to about 100 cm are particularly preferred, although shorter or longer read ranges may also be acceptable. The particular tag 110 illustrated is the 13.56 mHz tag sold under the brand name Taggit™ available from Texas Instruments, Inc. (http://www.tiris.com, Product No. RI-103-110A). The tag 110 has a useful read/write range of about 25 cm and contains 256-bits of on-board memory arranged in 8×32-bit blocks which may be programmed (written) and read by a suitably configured read/write device. If a longer read/write range (e.g., 1–100 meters) and/or more memory (e.g., 1–100 Mb) is desired, optional battery-powered tags may be used instead, such as the AXCESS active RFID network system available from ACXESS, Inc. and/or various other RF-based asset and people tracking applications known to those skilled in the art.

Figure 6:
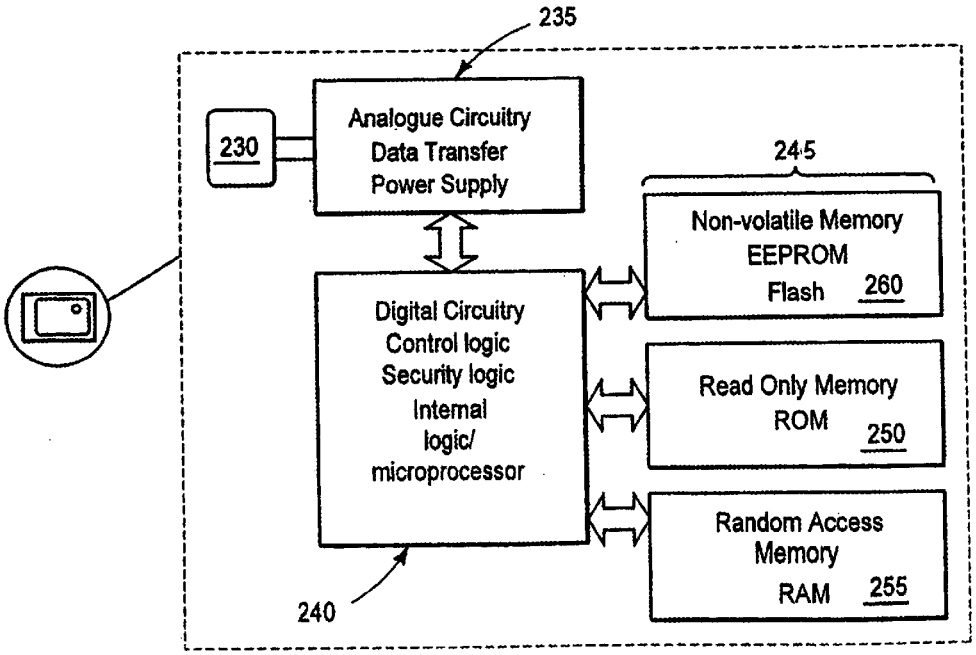
FIG. 6 is a simplified block diagram illustrating the basic organization and function of the electronic circuitry comprising the RFID tag device of FIG. 3.

FIG. 6 is a simplified block diagram illustrating the basic organization and function of the electronic circuitry comprising the radio frequency transmitter chip 160 of the RFID tag device 110 of FIG. 2. The chip 160 basically comprises a central processor 230, Analogue Circuitry 235, Digital Circuitry 240 and on-board memory 245. On-board memory 245 is divided into read-only memory (ROM) 250, random access memory (RAM) 255 and non-volatile programmable memory 260, which is available for data storage. The ROM-based memory 250 is used to accommodate security data and the tag operating system instructions which, in conjunction with the processor 230 and processing logic deals with the internal "house-keeping" functions such as response delay timing, data flow control and power supply switching. The RAM-based memory 255 facilitates temporary data storage during transponder interrogation and response. The non-volatile programmable memory 260 may take various forms, electrically erasable programmable read only memory (EEPROM) being typical. It is used to store the transponder data and is preferably non-volatile to ensure that the data is retained when the device is in its quiescent or power-saving "sleep" state.

Various data buffers or further memory components (not shown), may be provided to temporarily hold incoming data following demodulation and outgoing data for modulation and interface with the transponder antenna 150. Analog Circuitry 135 provides the facility to direct and accommodate the interrogation field energy for powering purposes in passive transponders and triggering of the transponder response. Analog Circuitry also provides the facility to accept the programming or "write" data modulated signal and to perform the necessary demodulation and data transfer processes. Digital Circuitry 240 provides certain control logic, security logic and internal microprocessor logic required to operate central processor 230.

Advantageously, the UBIN stored on each tag 110 may be used to wirelessly identify and track individual bears 100 within a retail facility, park, hotel/resort/restaurant and/or anywhere else around the world. Optionally, each tag 110 may also include a unique kid identifier number ("UKIN") which may be used to match one or more bears with an individual kid-owner. If desired, the tag 110 may be covered with an adhesive paper label (not shown) for surface adhesion to a toy, clothes, or any other tag bearing surface. More preferably, the tag 110 may be molded and/or embedded into a relatively stiff plastic sheet substrate and/or transponder cylinder which holds and supports the tag 110. Optionally, the sheet substrate, transponder or other support structure may be shaped as a heart, a medallion, a high-tech gizmo or any other fanciful shape, as desired. The resulting structures may be inserted into the bear 100 (e.g., a heart), or they may be worn externally by either the bear 100 and/or its kid-owner (e.g., as a bracelet, necklace, key chain trinket, etc.).

Reader/Writer Devices

In operation, various RFID reader (and/or reader/writer) devices are provided and may be distributed throughout a hotel/resort, retail facility, play facility, theme park, family entertainment center or any other "magic bear" compatible environment. These readers are able to read the information stored on each tag 110 when the associated bear 100 is brought into suitable proximity of the reader (1–100 cm).

Advantageously, because radio waves can easily penetrate solid objects, such as the outer skin of a toy and/or the like, the tag 110 can be mounted internally within a cavity of the toy, thereby providing communication of stored information without requiring surgical extraction of the tag. Thus, the UBIN and UKIN information can be conveniently read non-invasively, without damaging the toy. This information may be easily communicated to a cash-register display, computer monitor, interactive game control system, display system or other tracking, recording or displaying device for purposes of identifying, logging and creating a record of each bear's experience. Additional information (e.g., unique personality traits, special powers, skill levels, etc.) can also be easily stored on the tag, thus providing further personality enhancement, input/output programming, simulated intelligence and/or interactive gaming possibilities.

Information may also be conveniently used to identify a bear's name, birthday, and owner, calculating point totals from various gaming experiences, tracking and/or locating lost bears/children, verifying whether or not a bear/child is inside a facility, photo capture & retrieval, and/or many other useful purposes as will be readily obvious and apparent to those skilled in the art. Optionally, various updated information may be written to the tag 110, such as new point totals, rank, enhanced "magic" powers and skills.

Figure 4A:
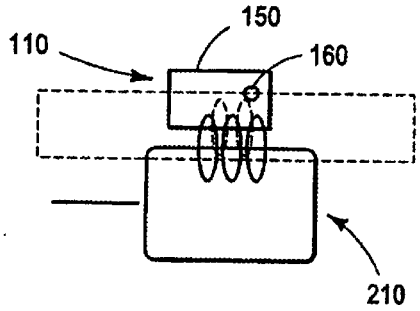
FIGS. 4A and 4B are schematic diagrams illustrating typical operation of the RFID tag device of FIG. 3.
Figure 4B:
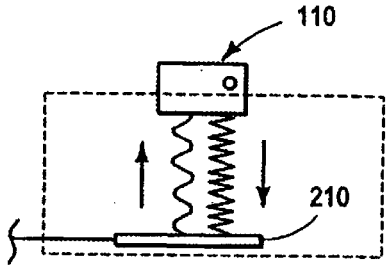
Figure 5:
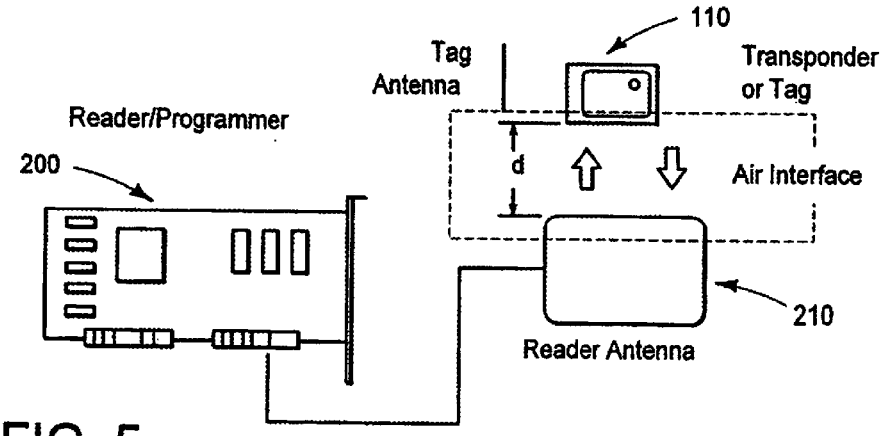
FIG. 5 is simplified schematic diagram of an RFID read/write system for use with the RFID tag device of FIG. 3 and having features and advantages in accordance with the present invention.

FIGS. 4A, 4B, and 5 are simplified schematic illustrations of tag and reader operation. The tag 110 is initially activated by a radio frequency signal broadcast by an antenna 210 of an adjacent reader or activation device 200. The signal impresses a voltage upon the antenna 150 by inductive coupling which is then used to power the chip 160 (see, e.g., FIG. 3). When activated, the chip 160 transmits via radio frequency a unique identification number preferably corresponding to the UBIN and/or UKIN described above (see, e.g., FIG. 3 and associated discussion). The signal may be transmitted either by inductive coupling or, more preferably, by propagation coupling over a distance "d" determined by the range of the tag/reader combination. This signal is then received and processed by the associated reader 200 as described above. If desired, the RFID tag or transponder 110 may also be configured for read/write communications with an associated reader/writer. Thus, the unique tag identifier number (UBIN or UKIN) and any other stored information can be read, changed or other information may be added.

As indicated above, communication of data between a tag and a reader is by wireless communication. As a result, transmitting such data is possibly subject to the vagaries and influences of the media or channels through which the data has to pass, including the air interface. Noise, interference and distortion are potential sources of data corruption that may arise. Thus, those skilled in the art will appreciate that a certain degree of care should be taken in the placement and orientation of the various readers 200 so as to minimize the probability of such data transmission errors. Preferably, the readers are placed at least 30–60 cm away from any metal objects, power lines or other potential interference sources. Those skilled in the art will also recognize that the write range of the tag/reader combination is typically somewhat less (~10–15% less) than the read range "d" and, thus, this should also be taken into account in determining optimal placement and positioning of each reader device 200.

Typical RFID data communication is asynchronous or unsynchronized in nature and, thus, particular attention should be given in considering the form in which the data is to be communicated. Structuring the bit stream to accommodate these needs, such as via a channel encoding scheme, is preferred in order to provide reliable system performance. Various suitable channel encoding schemes, such as amplitude shift keying (ASK), frequency shift keying (FSK), phase shift keying (PSK) and spread spectrum modulation (SSM), are well know to those skilled in the art and will not be further discussed herein. The choice of carrier wave frequency is also important in determining data transfer rates. Generally speaking the higher the frequency the higher the data transfer or throughput rates that can be achieved. This is intimately linked to bandwidth or range available within the frequency spectrum for the communication process. Preferably, the channel bandwidth is selected to be at least twice the bit rate required for the particular application.

Master Control System

Figure 7:
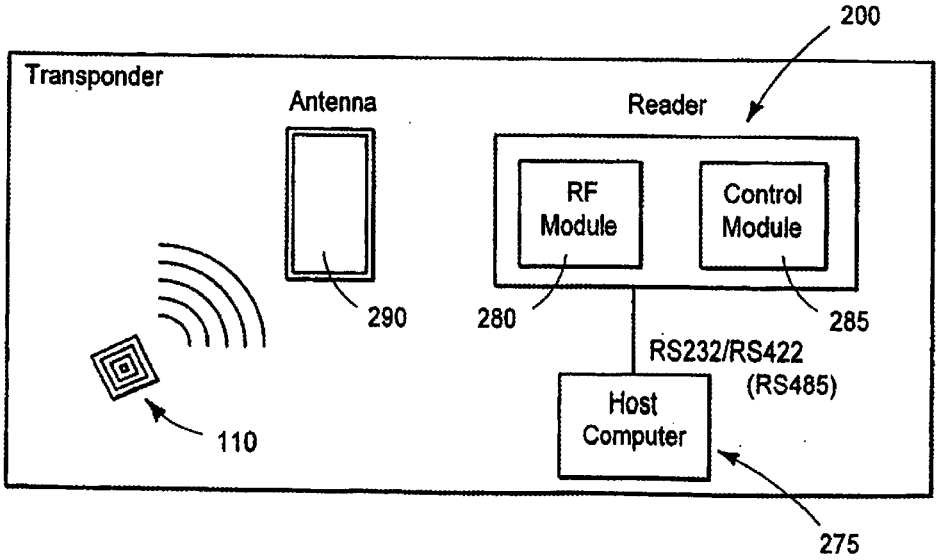
FIG. 7 is a simplified schematic diagram of an RF reader and master control system for use with the RFID-tagged toys of FIGS. 1 and 2 and having features and advantages in accordance with the present invention.

Depending upon the degree of complexity desired and the amount of information sharing required, some or all of the various reader/writer devices 200 may be connected to a master control system or central server 375 as illustrated in FIG. 7. For example, various electronic interactive play elements may be disposed throughout a play facility and which allow play participants to create desired "magical" effects. These may include interactive elements such as projectile accelerators, cannons, interactive targets, fountains, geysers, cranes, filter relays, and the like for amusing and entertaining play participants and/or for producing various desired visual, aural or tactile effects. These may be actuated manually by play participants or, more desirably, "magically" electronically by appropriately "training" one's bear in various magic skills. Some interactive play elements may have simple immediate effects, while others may have complex and/or delayed effects. Some play elements may produce local effects while others may produce remote effects. Each play participant within the facility, or sometimes a group of play participants working together, preferably must experiment with the various play elements and using their magic bears in order to discover how to create the desired effect(s). Once one play participant figures it out, he or she can use the resulting play effect to surprise and entertain other play participants. Yet other play participants will observe the activity and will attempt to also figure it out in order to turn the tables on the next group. Repeated play on a particular play element can increase the bear's magic skills to repeatedly produce a desired effect or increase the size or range of such effects. Optionally, play participants can have their bears compete with one another using the various interactive play elements to see which player's bear can create bigger, longer, more accurate or more spectacular magical effects.

In the case of an interactive play facility with a master control system preferably each RFID tag 110 is configured to electronically send and receive information to and from each reader/writer 200 distributed throughout the play facility using a send receive radio frequency ("SRRF") communication protocol. This communications protocol provides the basic foundation for a complex, interactive entertainment system which creates a seemingly magic interactive play experience for participants who's bears learn to use the seemingly "magical" powers they are imbued with via the RFID tag technology.

In the most refined embodiments, a participant may use his or her "magic bear" or other similar toy to electronically send and receive information to and from other bears/toys and/or to and from a master control system located within and/or associated with any of a number of play environments. This network of SRRF-compatible play environments provides a complex, interactive play and entertainment system that creates a seamless magical interactive experience that transcends conventional physical and temporal boundaries.

SRRF may generally be described as an RF-based communications technology and protocol that allows pertinent information and messages to be sent and received to and from two or more SRRF compatible devices or systems. While the specific embodiments described herein are specific to RF-based communication systems, those skilled in the art will readily appreciate that the broader interactive play concepts taught herein may be realized using any number of commercially available 2-way and/or 1-way medium range wireless communication devices and communication protocols such as, without limitation, infrared-, digital-, analog, AM/FM-, laser-, visual-, audio-, and/or ultrasonic-based systems, as desired or expedient.

In a preferred embodiment, a play facility is configured with SRRF technology to provide a master control system 275 for an interactive entertainment play environment using SRRF-compatible magic bears, magic wands and/or other SRRF compatible toys. A typical play facility provided with SRRF technology may allow 300–400 or more users to more-or-less simultaneously send and receive electronic transmissions to and from the master control system using the bear, a magic wand and/or other SRRF-compatible toys.

The SRRF system preferably uses a software program and data-base that can track the locations and activities of up to a hundred or more participants. This information is then used to adjust the play/ride experience for the user based on "knowing" where the user/player has been, what objectives that player (or group of players in a ride vehicle) has accomplished and how many points or levels have been reached. The system can then send messages to the users throughout the ride experience. For example, the system can allow or deny access to a secret passage based on how many points or levels reached by that participant's bear and/or based on what objectives the bear has accomplished or helped accomplish. It can also indicate, via sending a message to the user the amount of points or specific objectives necessary to complete a "mission" or enter the next level of play. The master control system may log events into a data base for later retrieval and use in applications, such as:

- Identifying a guest with a name, address and personal data (birthday, favorite color, bear's name, etc.)
- Locating the bear and child
- Triggering an event or special effect
- Allowing passage into a secret or magical place
- Recording activities completed, giving points for those achievements which then can be used for future redemption
- Storing information to create a storybook of each child's adventures
- Using bear/tag as a debit charge to purchase snacks, gift items, etc.

The master control system can also preferably send messages to the user from other users. Optionally, the system may be suitably configured to allow multiple users to interact with each other adjusting the mast control system. The master system can also preferably interface with digital imaging and/or video capture so that the users can be visually tracked. Any user can locate another user either through the video capturing system or by sending a message to another device. At the end of a visit, participants are informed of their activities and the system interfaces with photo-printout capabilities. For example, as each participant enters a specific "game zone" within the facility, a reader reads data stored on the tag 110 embedded with the participant's bear or other SRRF-compatible toy. This information is communicated to the master system which logs/tracks the guest's progress through the facility while interfacing with other interactive systems within the venue. For example, upon receipt of an activation message received from a first game zone, the master system may trigger a digital camera focused on that area, thus capturing a digital image of the player and/or his or her bear. This photo image is electronically time-stamped and stored with identifying UBIN and UKIN for later retrieval. In this manner the SRRF technology allows the master control system to uniquely identify and track bears and people as they interact with various games and activities in a semi-controlled play environment.

Theming/Storyline

The present invention may be carried out using a wide variety of suitable themed environments, storylines and characters, as will be readily apparent to those skilled in the art. The following specific example is provided for purposes of illustration and for better understanding of the invention and should not be taken as limiting the invention in any way:

EXAMPLE

In a special spot of the world exists an incredible place made of magic. In the most amazing and enchanting forest lives an amazing wizard who has spent his life making cuddly critters who posses unusual abilities. These critters look like ordinary teddy bears or stuffed animals; cute and cuddly ready to become a child's best friend. But behind the fluff and stuffing this one-of-kind bear is Magical. Each and every bear was carefully created by this Wizard, has made thousands of unique stuffed creatures with the gift to become magical. However, these creations do not start off with magic powers. Only when the bear and its human mate are brought together the magic is sparked. But even then the bear is not yet able to use all of its magic powers until it is properly taught. It is the responsibility of the human to take the bear on a magic journey through the Enchanted Forest where the magic teachings begins. Then, for days to follow the bear is able to practice its magic powers in all sort of "normal" places. When the training and practice is complete, the bear is given its magic inductions and diploma (a hat, wand, etc., as appropriate) and is able to practice level-one magic. The magic bear's owner can then choose from a big selection of special clothing, accessories and other magical items to customize their new friend. New and improved magic skills can be learned by the magic bear and its human mate on its next journey to the enchanted forest.

The "MagicMate" is a specially designed stuffed animal that has "smart" ability (RFID tag/transponder), which makes it possible to be tracked and trigger effects throughout a special bear training facility (e.g., retail store, hotel/resort, family entertainment center, etc.). The facility can track and send signals to the bear from the time it is purchased and continuing even after the bear leaves the training facility. To the child/owner the bear is truly magical; making effects happen whenever the bear comes into contact with a magic-bear compatible device. In addition, the bear seems to be magically watched by the Wizard who seems to always know where the bear is and what it is doing.

For example, the bear training center may be located within a family hotel/resort. The experience begins when the guest (or the guests parents) reserve a room at the resort. They are given a special invitation to become a special owner to a magic bear who needs their help to become magical. They are given a basic background of the experience and the story behind Magic Mates. Guests who choose to participate would be assigned a specially designed magic-ready hotel room. Guests can also choose to partake any time they are staying at the resort. Of course, visitors not staying at the hotel may also purchase a magic-mate.

Figure 8:
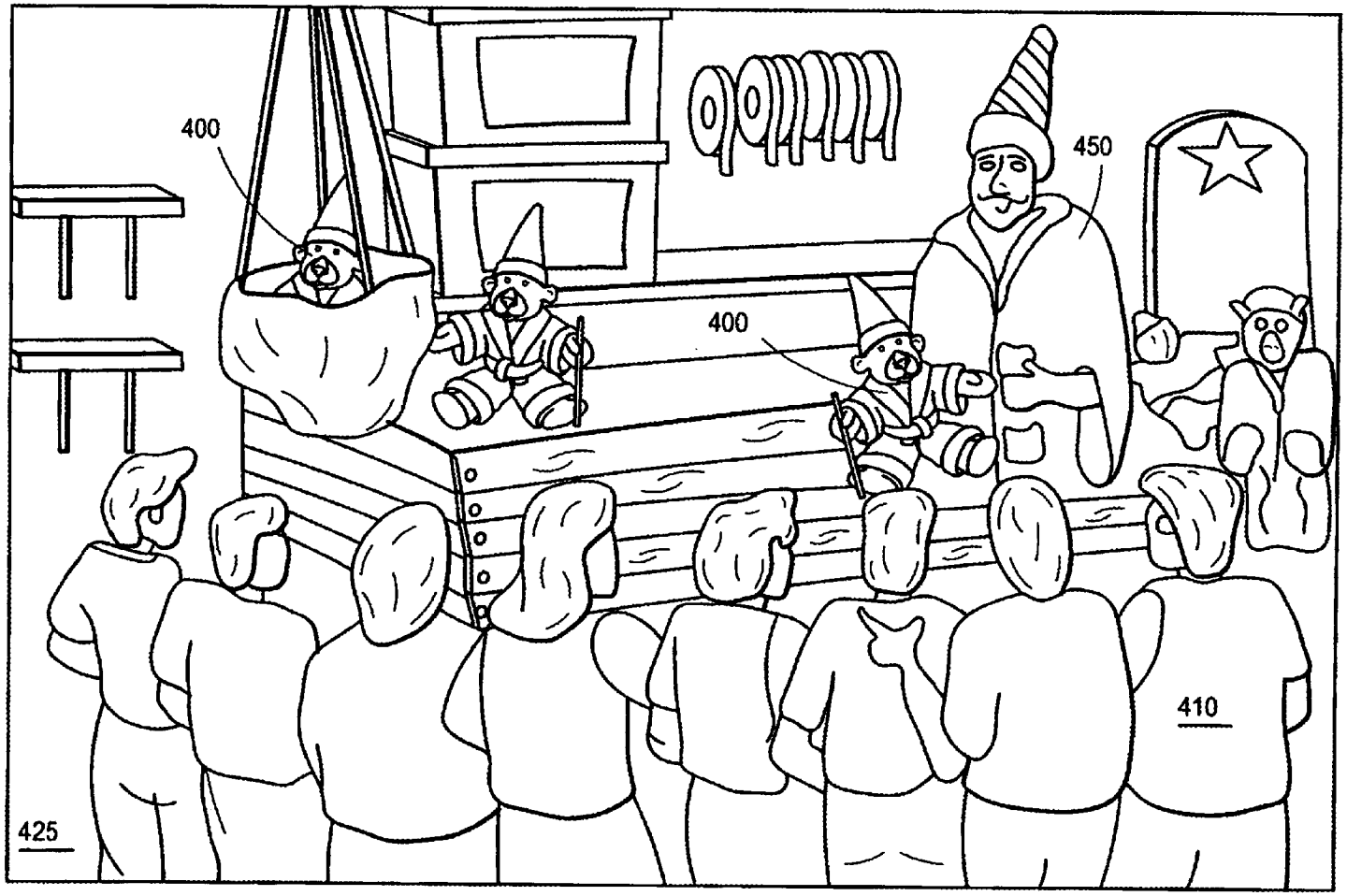
FIGS. 8–23 are various illustrations of a resort-based "magic bear" training facility having features and advantages of the present invention.
Figure 9:
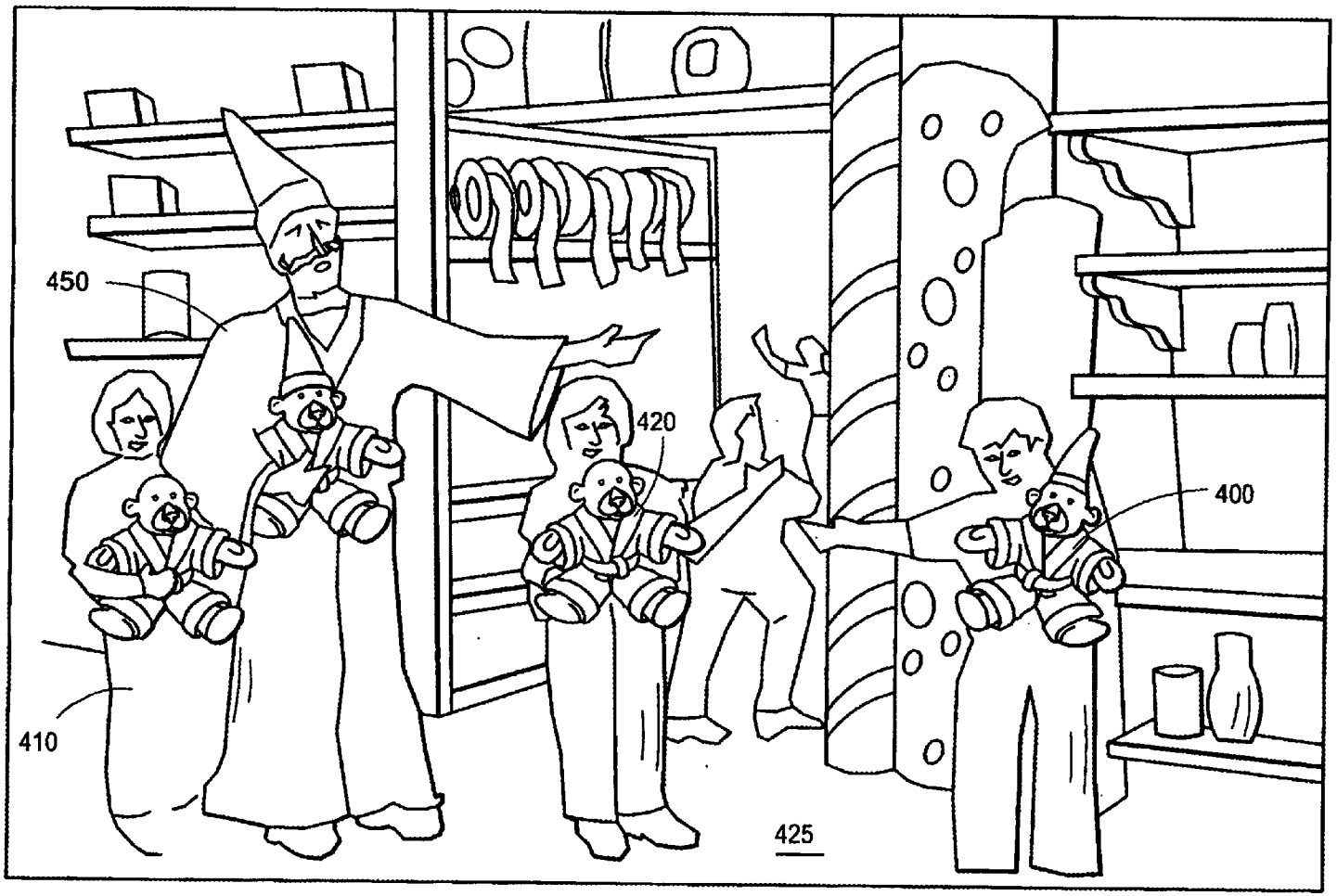

Once guests 410 arrive at the resort they select a time in which they will meet the Wizard 450 at his workshop 425 and finally are joined with their new magical friend 400 (FIGS. 8–9). When the guest arrives at this The Wizard Workshop 425 they are greeted by a Wizard 450 or two who lead them into the Wizard Workshop where they carefully select their magic mate 400. The guests are led into the workshop by a masterful Wizard who introduces them to his special creations. The Wizard also tells guests about his magical workshop and how he created these special bears for over 200 years and then helps the guests select their new magic-mate. Guests are asked to sign official adoption papers (initial identification process: name, address, bear name, etc.) and told how to care for their magic bear. The Wizard performs a special trick that "sparks" the bears magic so that it can begin its magic training with its new owner.

Figure 11:
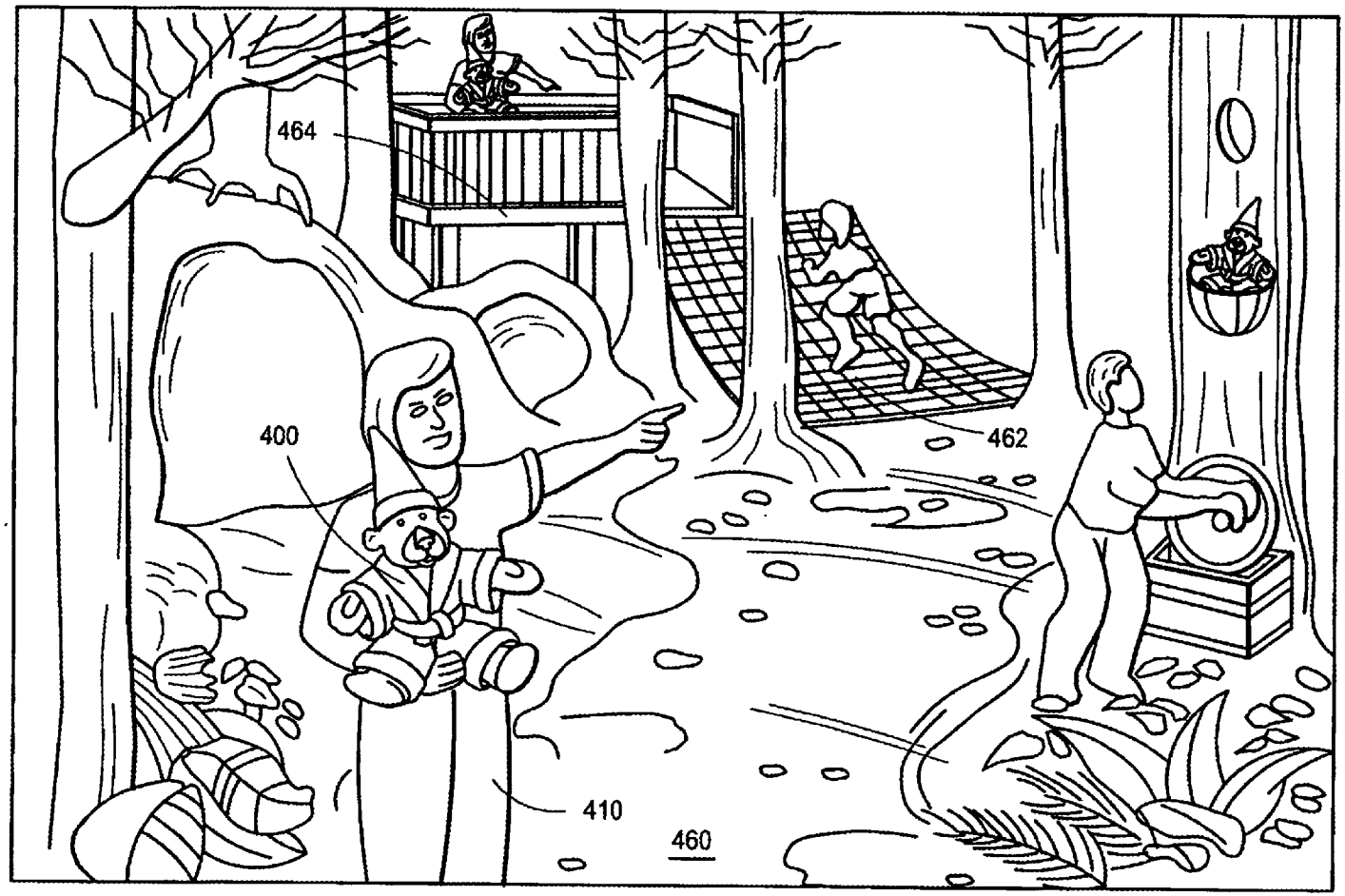
Figure 12:
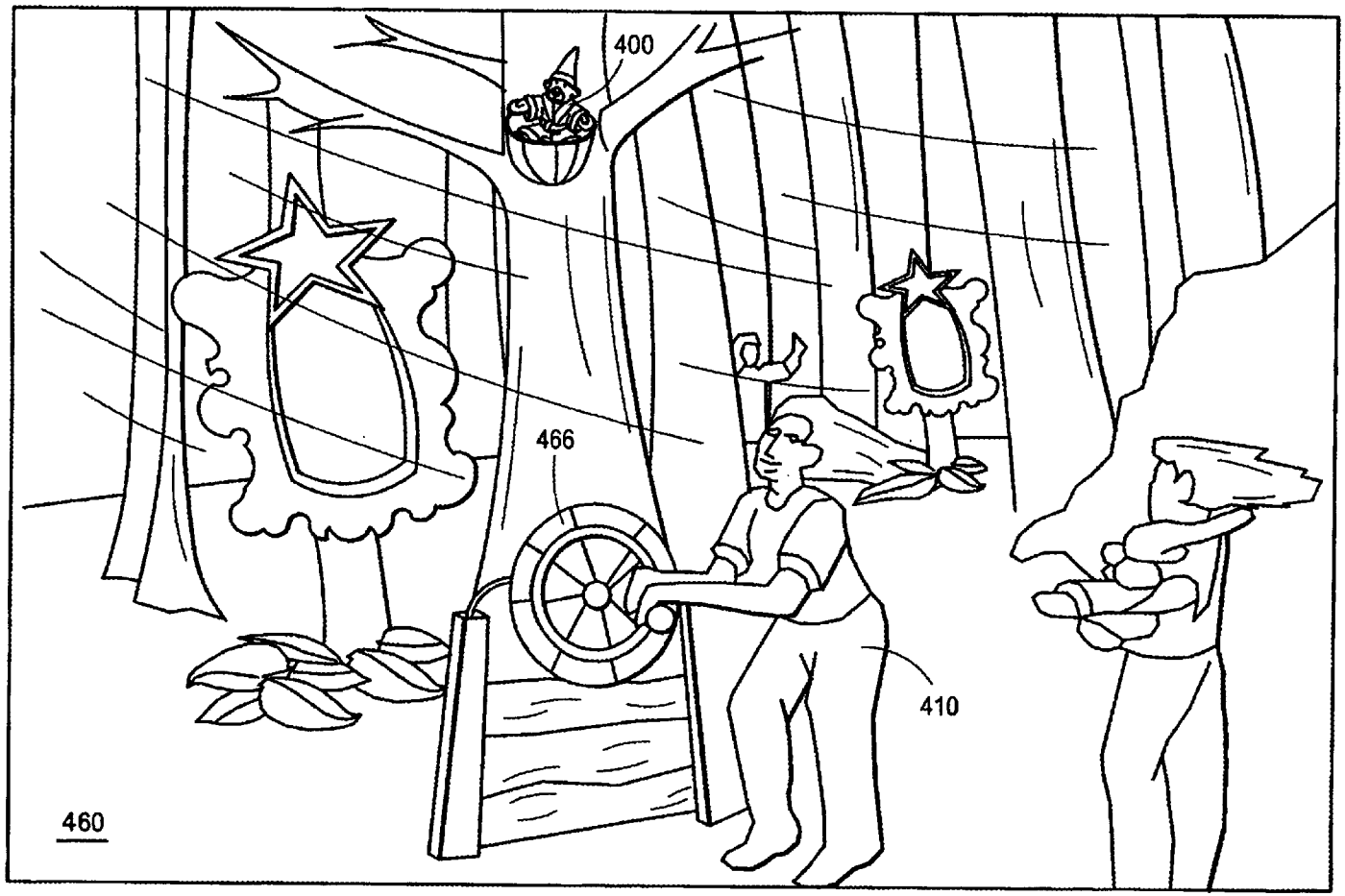
Figure 13:
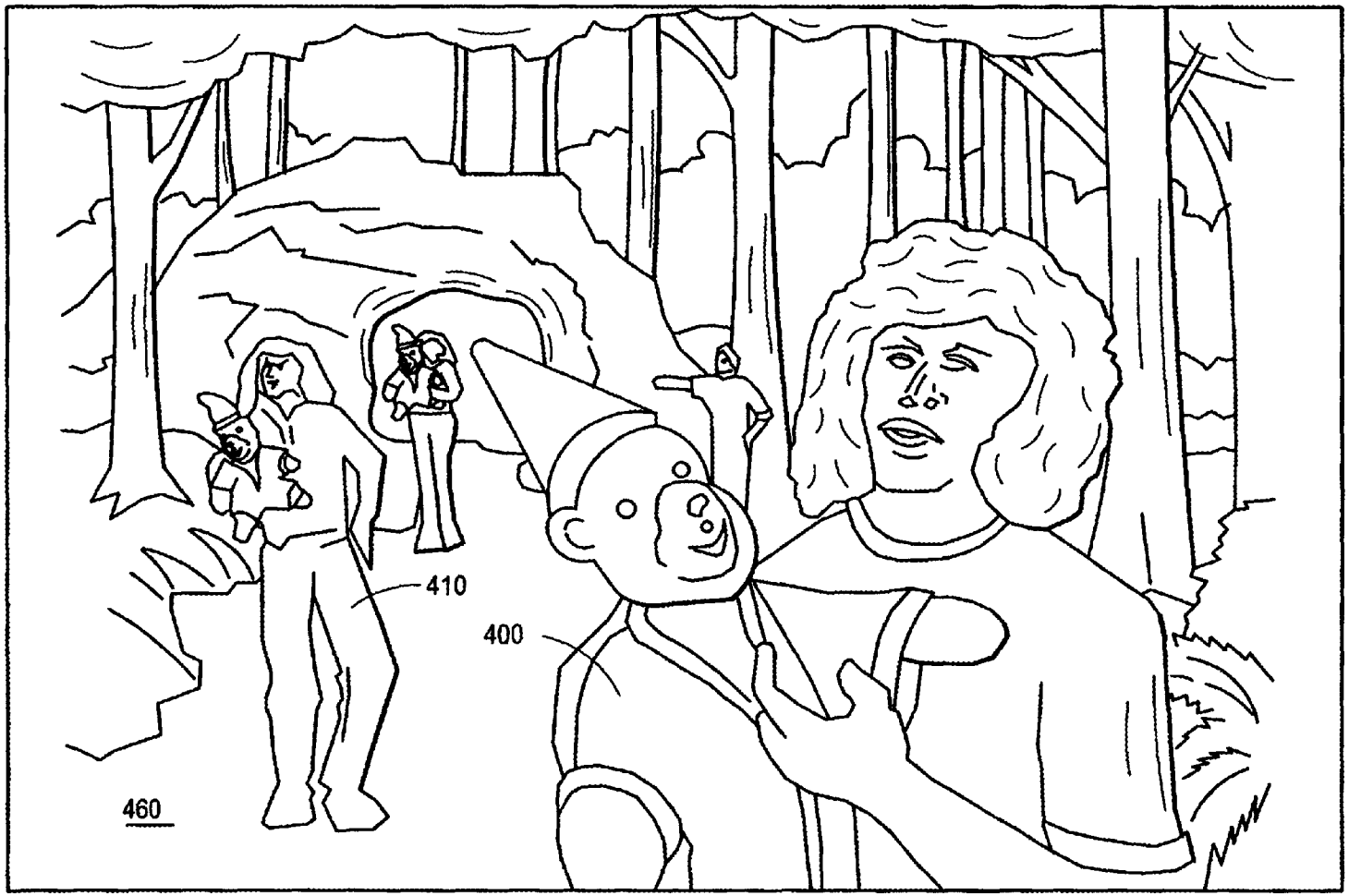

After guests choose their mate they are given official adoption papers, name their bear and the "story" (tracking) of the bear begins. They are then led through a hidden door, through a magical tunnel (FIG. 10) which takes them into the Enchanted Forest 460 where the magic training commences. The Enchanting Forest is an interactive maze of physical and hands on challenges, such as climbing nets 462, rope bridges 464, bear elevators 466, and the like (FIGS. 11–13). The bear 400 is taken by its owner through a series of magical lessons and fun experiences which will teach the bear and the guest how to use their magic powers. Magic is truly created and the bear 400 is able to set off a series of special effects as well as respond to various signals. Guests work their way through various caves, trees and bridges to different magic stations that help them teach their bear new skills. Each station is outfitted with a reader/writer device that logs and activates an effect after the bear completes a certain skill. For example, the bear's owner must teach the bear a magic saying. When this magic saying is done in a specific way (hold your bear to the sky and say, "Swish, Swirl, Bluster and Blow, Make the winds gust and grow!") .the bears light will glow and powerful winds (high-powered fans) blow at the guests.

Figure 14:
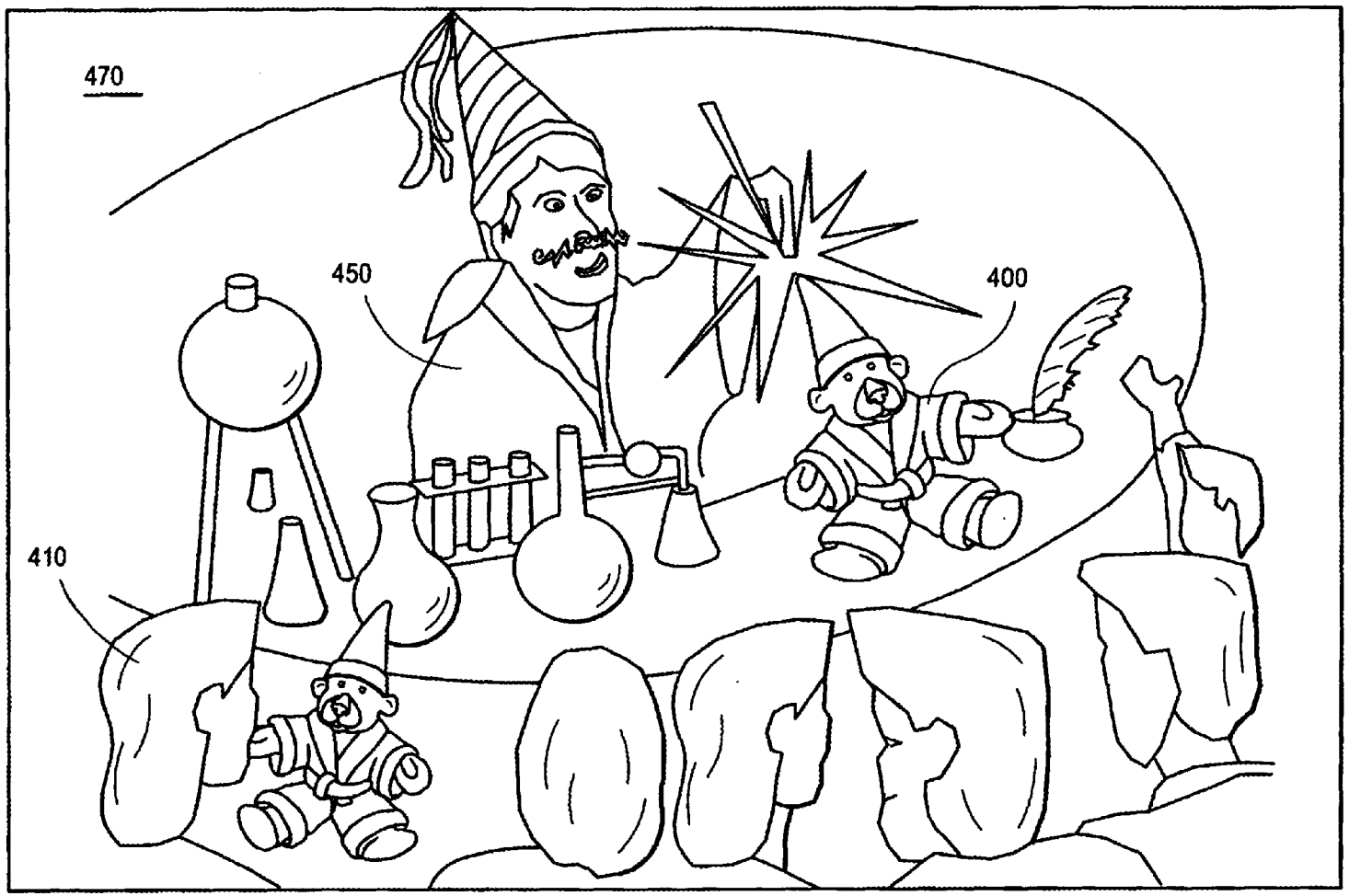
Figure 15:
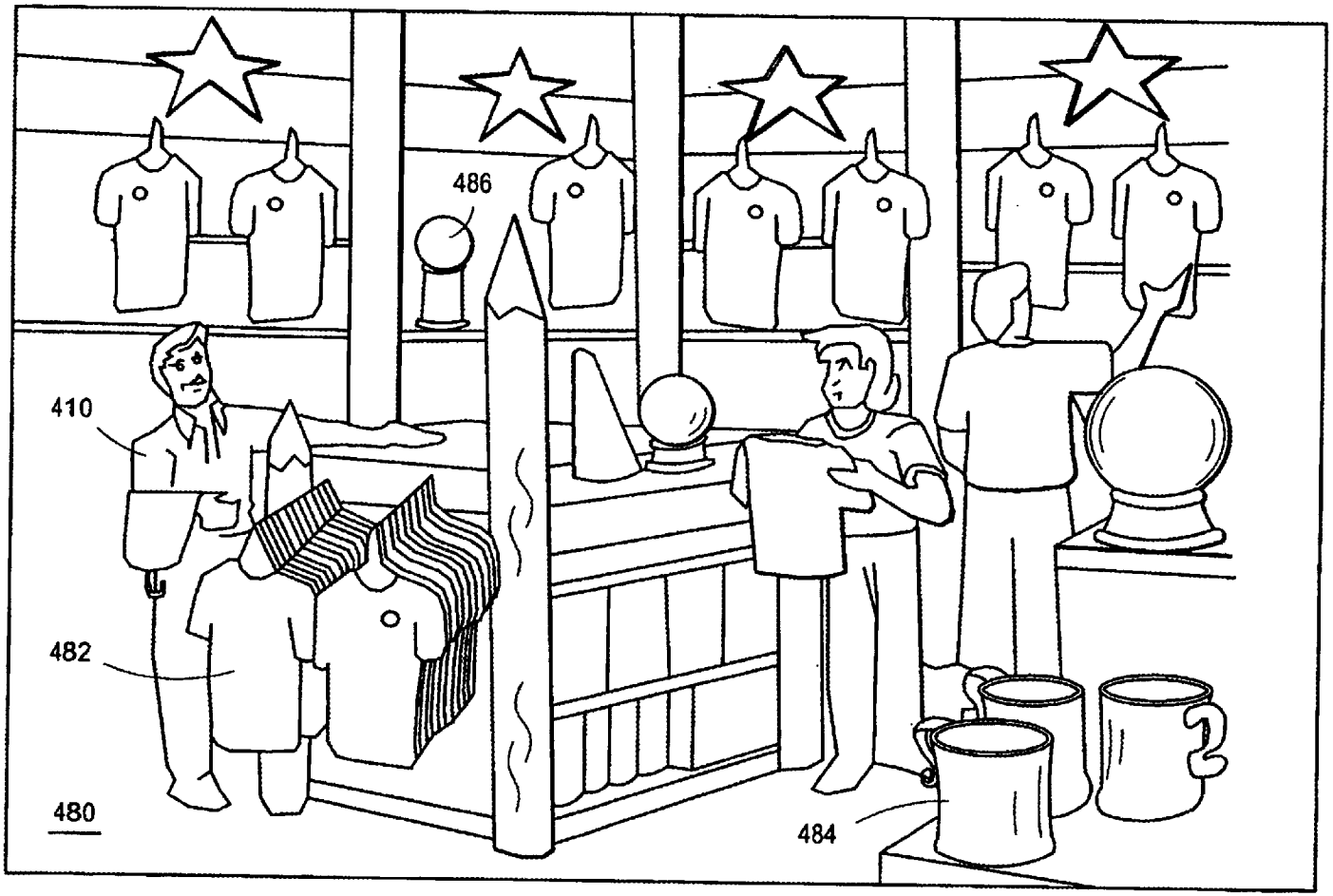

Once they make it through the Enchanted Forest they are then taken to a Wizard's Cove 470 (FIG. 14) where the Wizard 450 tests the bear's magic skills and official ceremonies are conducted. If they pass, they will be dubbed by the Wizard to have Level One Magic Powers. This area is actually a small theatre that uses a projected image of the Wizard and special effects. The bear will respond to signals that are integrated into the show. The guest then exits into a WizardWear shop 480 (FIG. 15) where he or she is able to select from dozens of outfits 482, accessories 484 and magical items 486.

Their magic experience doesn't end once guests exit the attraction area. Actually, the real experience begins. Various areas throughout the resort or equipped to track the bear and trigger events. Guests staying and paying for the Magic Mate Adventure have rooms that are outfitted with receivers that will cause specific events such as turn lights on and off and receive messages through the television. In addition, hallways, point portals (guest does an activity at a computer station and receives points for future redemption prizes), the restaurant and any other area at the resort have hidden receivers which will track the bear everywhere it goes. It will record the guest's activities as well as trigger effects such as talking pictures, sound and music effects.

Figure 16:
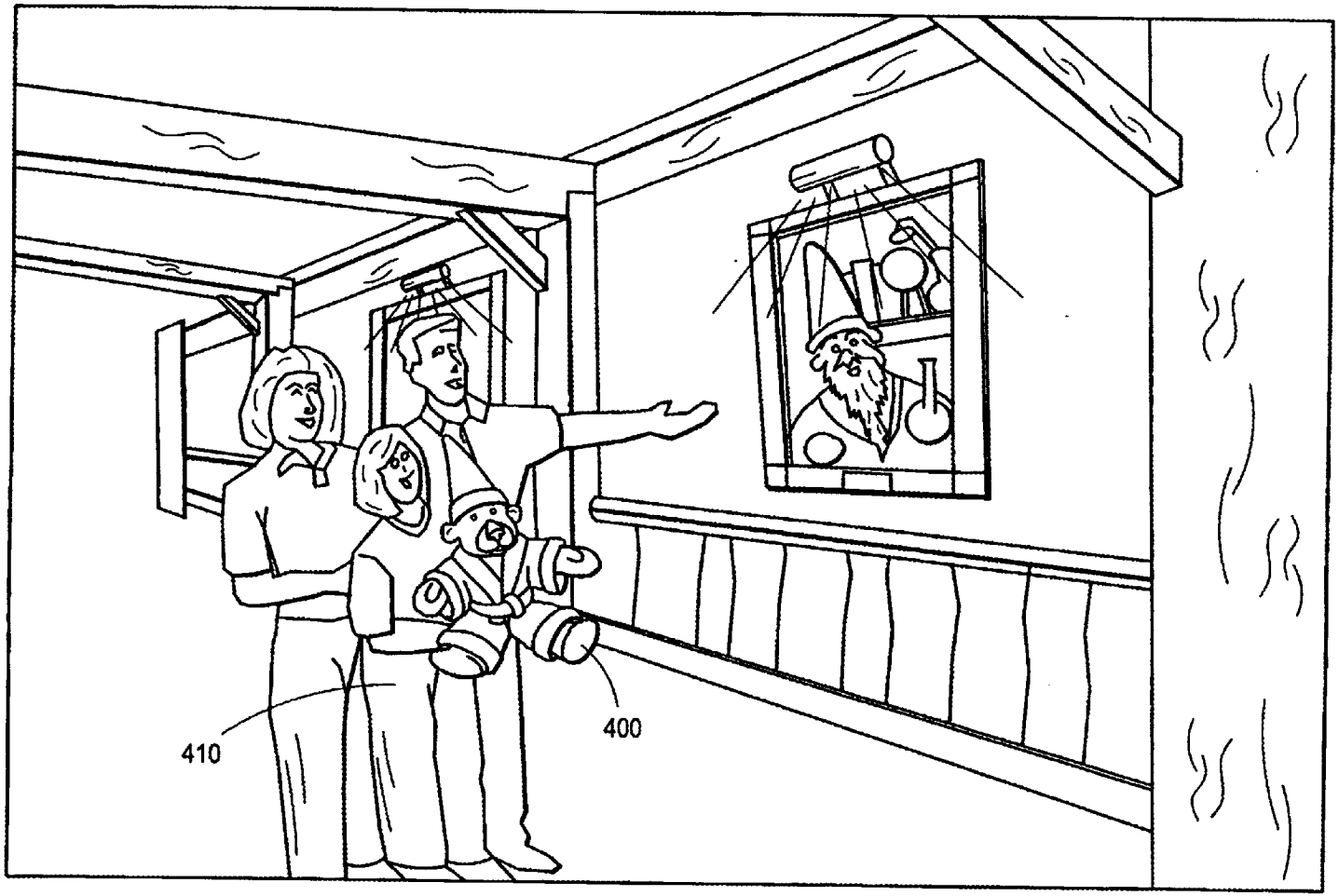
Figure 17:
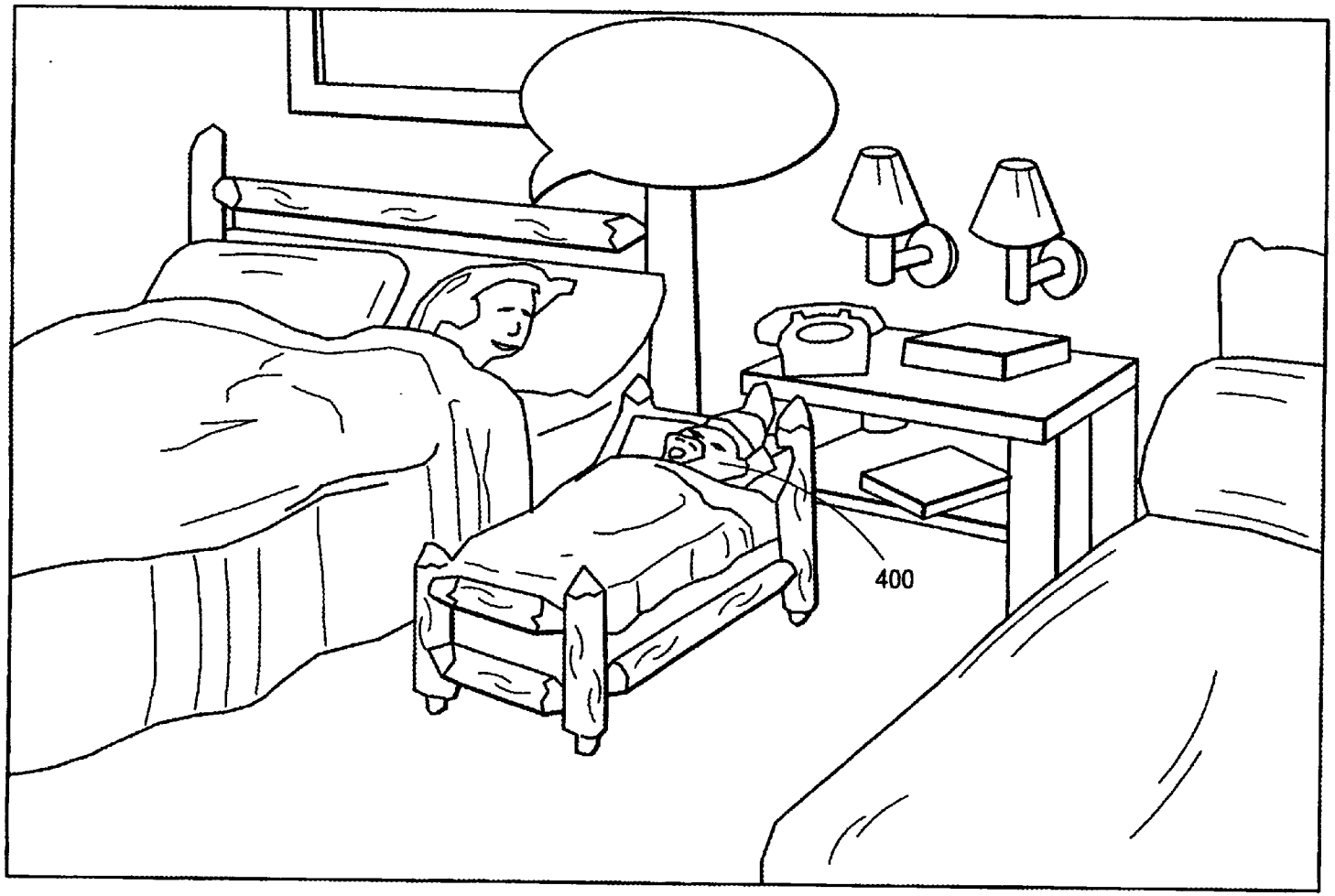
Figure 18:
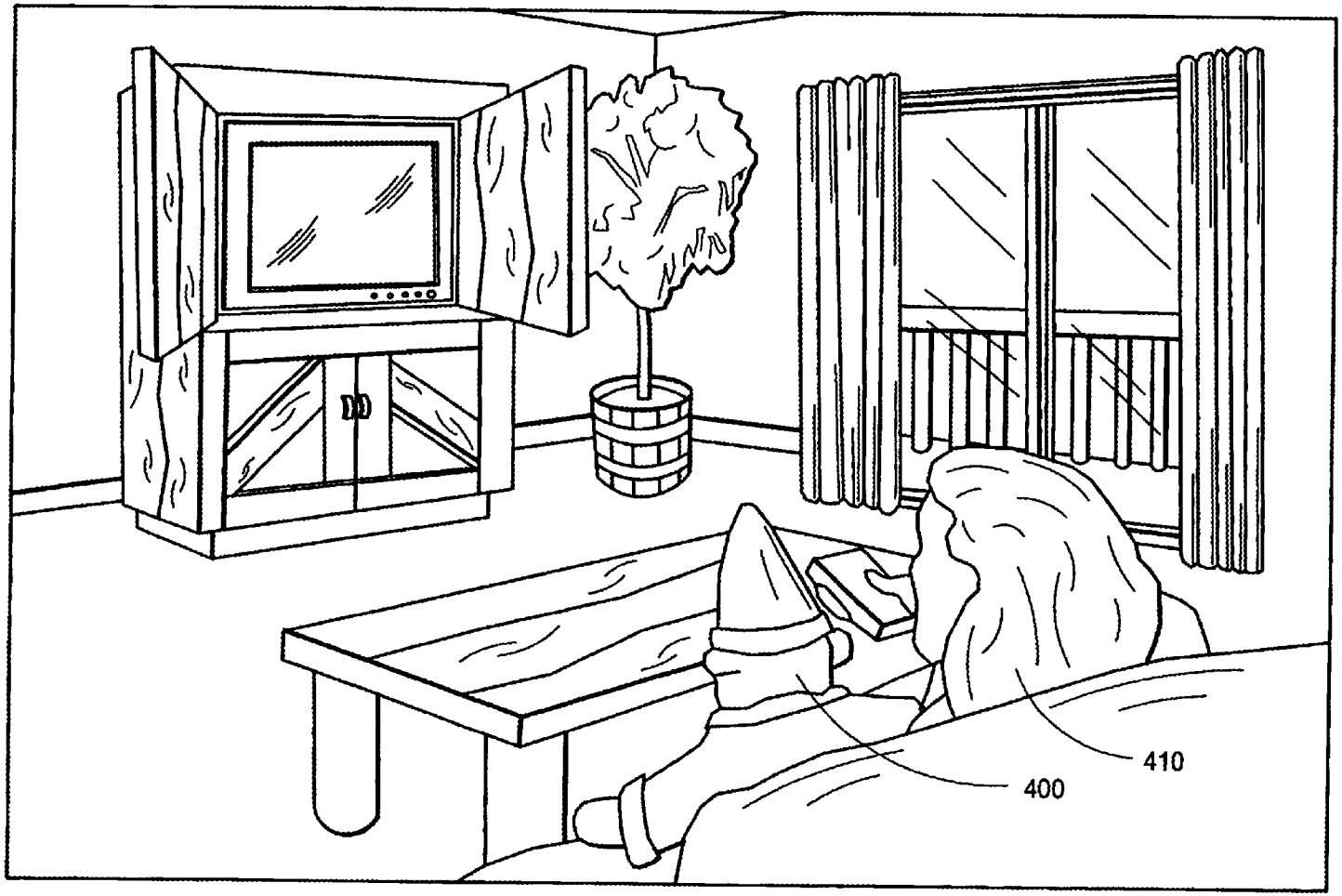

Throughout the resort are magic moments in which the bear will either set off a special effect, be asked to conduct a magic trick, take part in a photo opportunity, a story, event, party, game, etc. For example, as the guest walks down a hallway of the resort, pictures magically light up with magical images that address and speak to the bear (FIG. 16). In addition each of the guests staying at the hotel are given a room that has a special bed, telephone and toiletries for the bear. The room is also equipped and linked to the master system for special wake-up calls and magic tricks (FIGS. 17–18).

Figure 19:
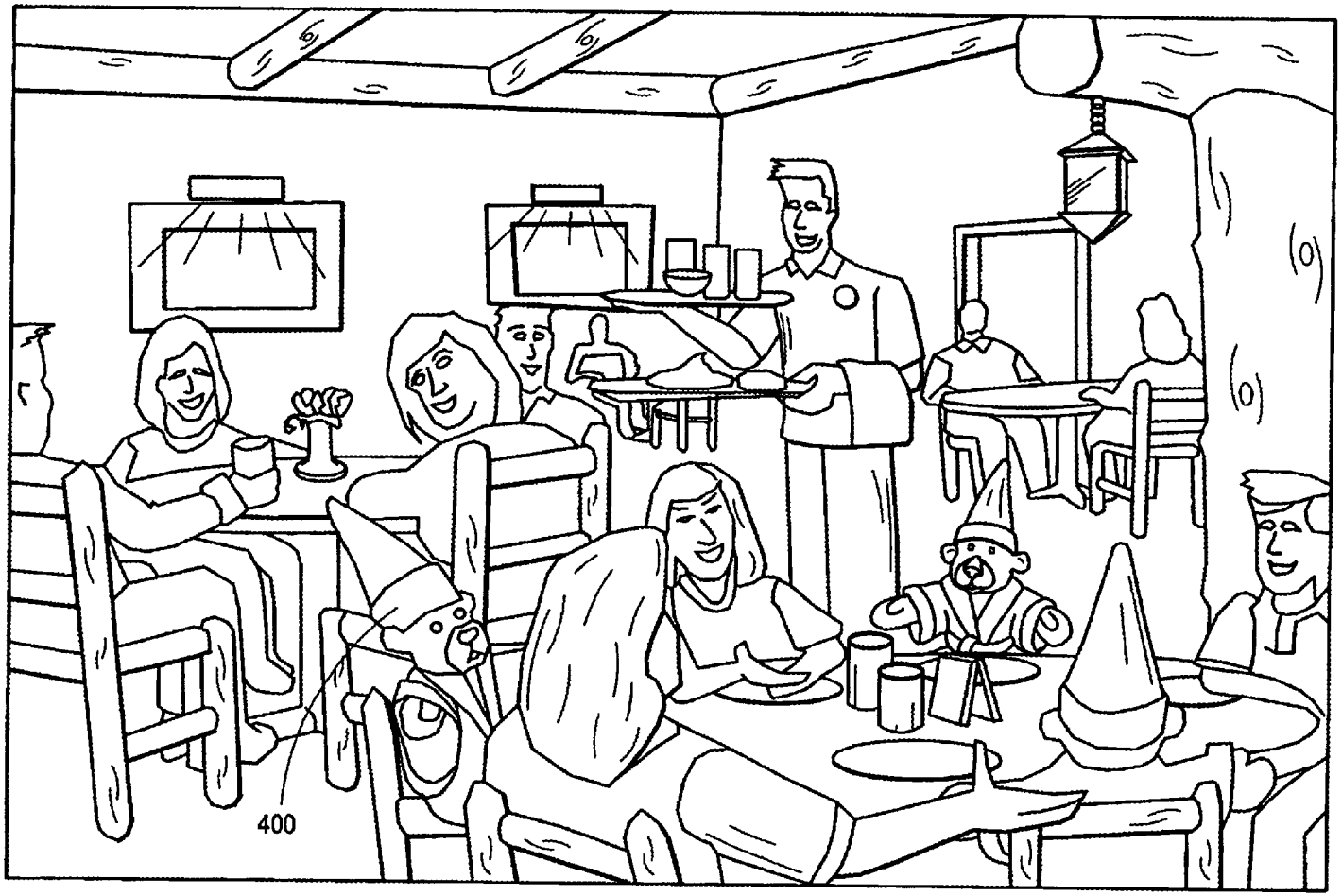
Figure 20:
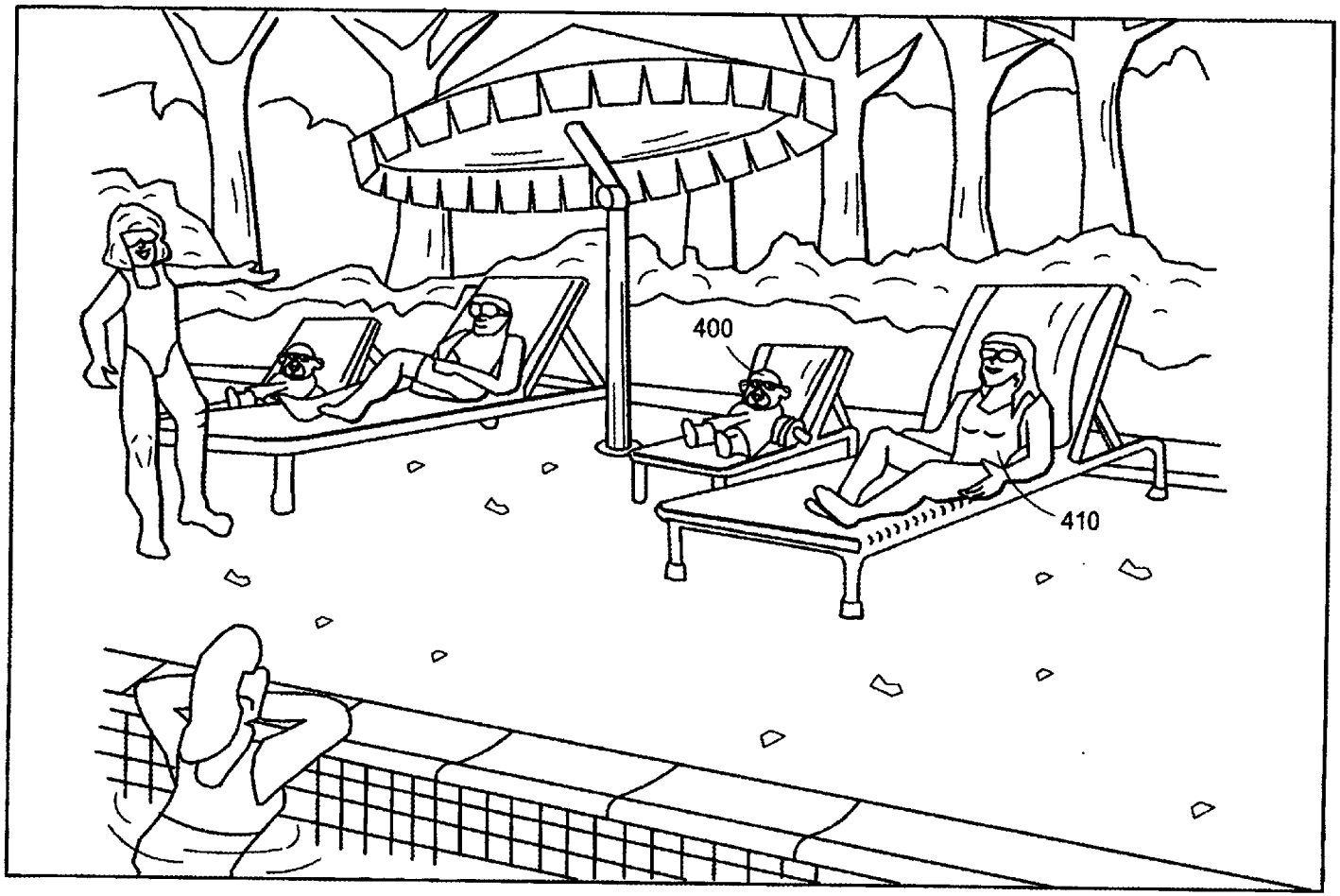
Figure 21:
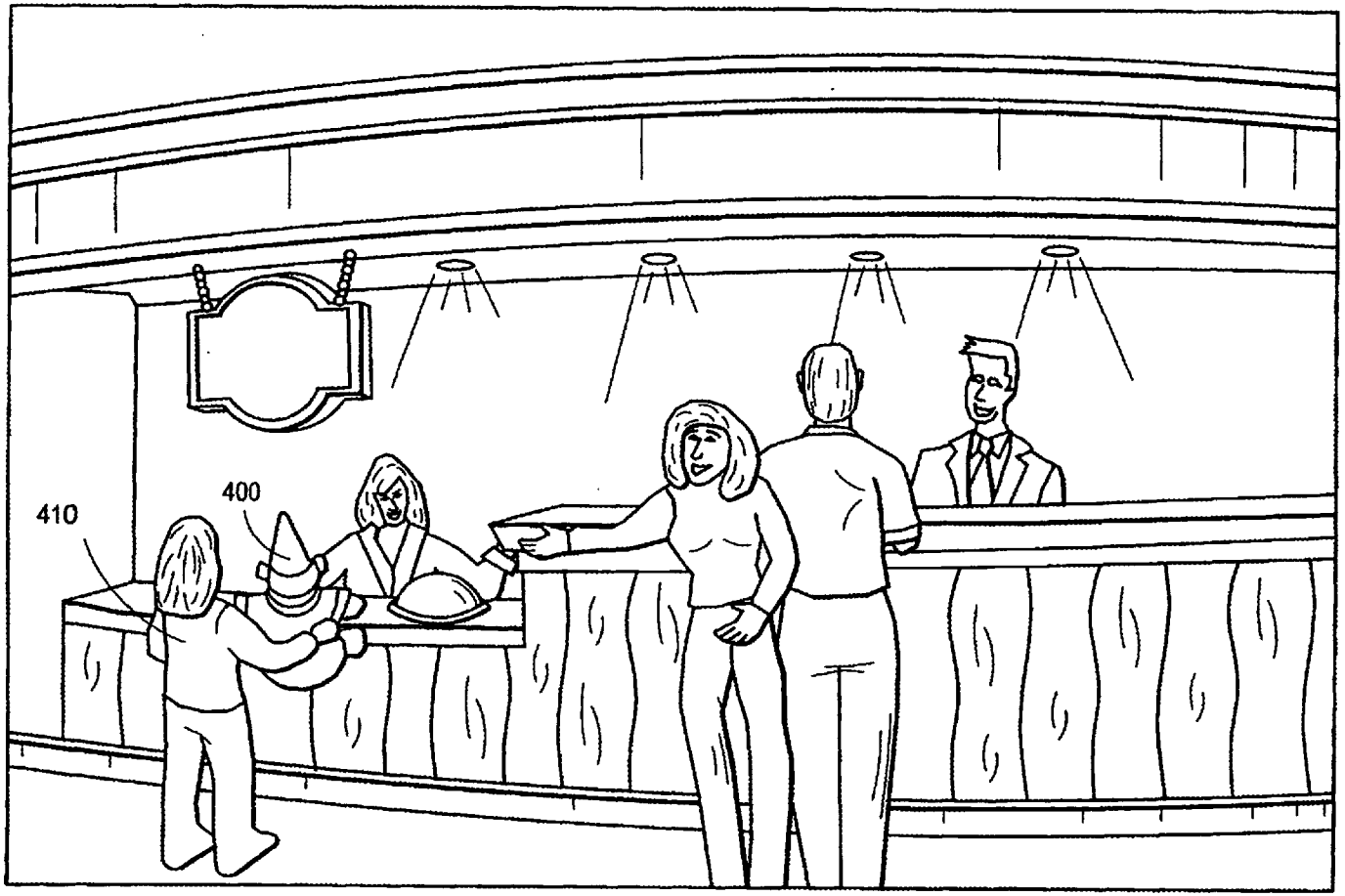

Other areas of the resort cater to the magic bear and the guest. The restaurant would have special seating for bears, a menu and special effects (FIG. 19). This would hold true for the pool with small lounge chairs for bears, a concierge desk for the bears and daily events for human and bear mates (FIGS. 20–21).

Figure 22:
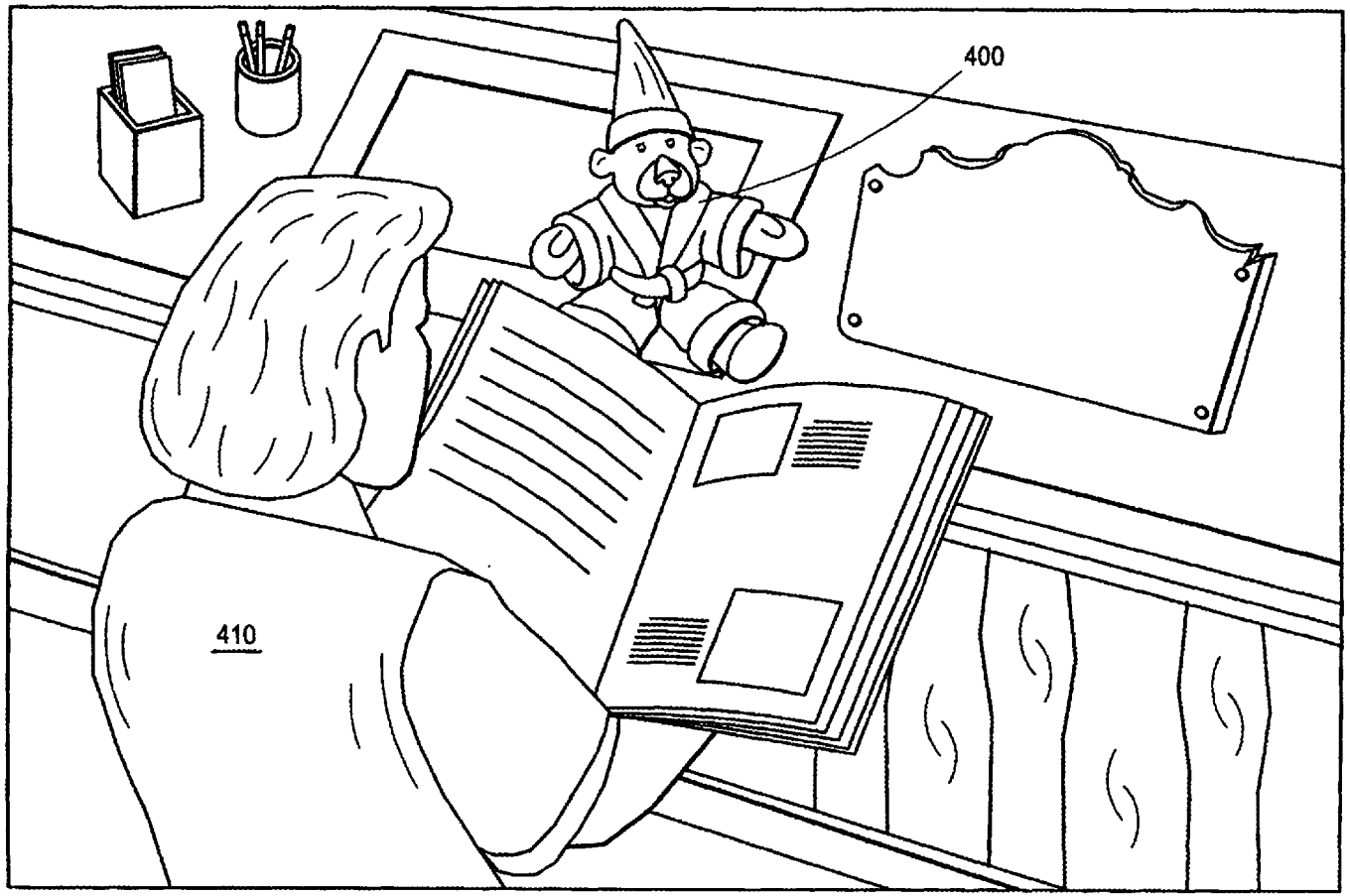
Figure 23:
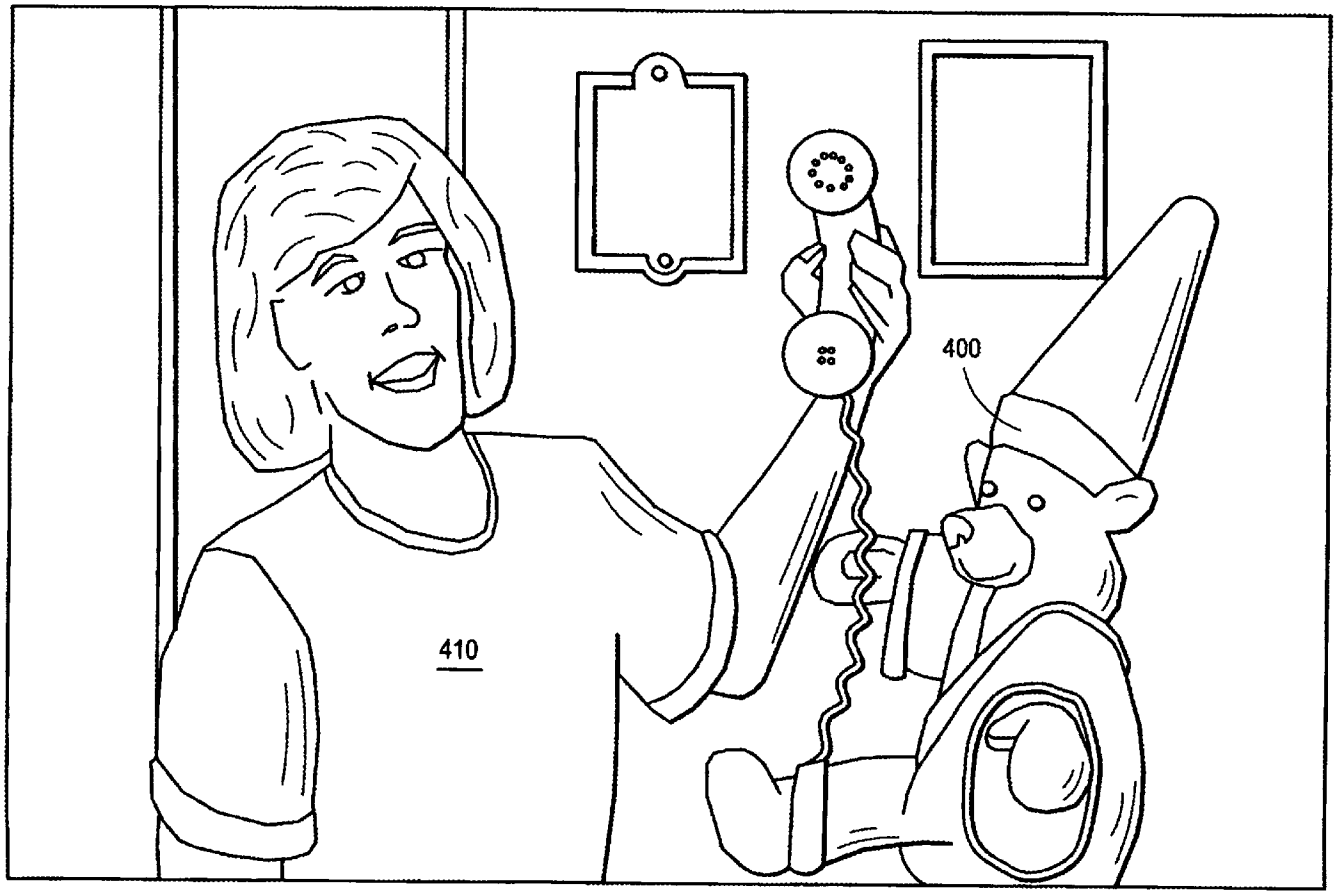

Overall, a magical story is created by tracking the guest and his or her bear throughout their stay. It will turn their events (their magical journey, when they go to dinner, play in the waterplay area, etc) at the resort into an imaginative story and give them a special book that recorded their memorable experiences. It is possible to include photo capturing or designated specific points as "photo-op" for their storybook. At check out the bear and its owner are presented with a printed photo-scrapbook 490 of their magical experience at the resort (FIG. 22). Other possibilities for continuing magic include:

- Visits to other facilities to increase magic skills and reach new levels
- Special events and festivals for the bear to attend
- New magic levels the bear must obtain in order for it to reach its fullest potential.
- Catalogs with new clothing to purchase
- Magic can also come to the home through telephone calls, Internet, etc.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. A children's toy comprising a doll, puppet or stuffed animal having an outer skin or covering and containing therein a concealed wireless, batteryless tag/transponder configured and adapted to provide storage and retrieval of desired information and wherein said tag/transponder enables communication of said stored information wirelessly through said outer skin or covering without requiring removal or exposure of said tag/transponder.

2. The children's toy of claim 1 wherein said tag/transponder comprises a radio-frequency transmitter.

3. The children's toy of claim 1 wherein said tag/transponder comprises an RFID tag.

4. The children's toy of claim 3 wherein said RFID tag is configured to operate at one or more of the following frequencies: 134.2 kHz, 123.2 kHz or 13.56 mHz.

5. The children's toy of claim 3 wherein said RFID tag comprises a 13.56 mHz read/write label tag.

6. The children's toy of claim 3 wherein said RFID tag comprises a 134.2 kHz and/or 123.2 kHz, 23 mm glass transponder.

7. The children's toy of claim 3 wherein said RFID tag is configured and adapted to use a send/receive radio frequency communication protocol.

8. The children's toy of claim 3 wherein said RFID tag is enveloped, contained or otherwise embodied in a generally heart-shaped trinket or case or other shape or form generally representing or symbolizing the heart or life source of the doll, puppet or stuffed animal.

9. The children's toy of claim 1 comprising multiple concealed wireless tag/transponders.

10. The children's toy of claim 1 wherein said stored information comprises one or more of the following: toy name, birthday, owner, points, rank, tasks completed, or places visited.

11. A children's toy comprising a stuffed animal having an outer skin or covering and an inner stuffing, said stuffed animal containing therein a concealed wireless tag/transponder configured and adapted to provide storage and retrieval of certain desired information and wherein said tag/transponder comprises a read/write RFID tag adapted to send and receive said information wirelessly through said outer skin or covering without damaging said skin or covering and without requiring removal of said RFID tag.

12. The children's toy of claim 11 wherein said RFID tag is configured to operate at one or more of the following frequencies: 134.2 kHz, 123.2 kHz or 13.56 mHz.

13. The children's toy of claim 11 wherein said RFID tag comprises a 13.56 mHz read/write label tag.

14. The children's toy of claim 11 wherein said RFID tag comprises a 134.2 kHz and/or 123.2 kHz, 23 mm glass transponder.

15. The children's toy of claim 11 wherein said REID tag is configured and adapted to use a send/receive radio frequency communication protocol.

16. The children's toy of claim 11 wherein said RFID tag is enveloped, contained or otherwise embodied in a generally heart-shaped trinket or case or other shape or form generally representing or symbolizing the heart or life source of the stuffed animal.

17. The children's toy of claim 11 comprising multiple concealed wireless tag/transponders.

18. The children's toy of claim 11 wherein said stored information comprises one or more of the following: toy name, birthday, owner, points, rank, tasks completed, or places visited.

19. A stuffed animal having an outer skin or covering and an inner stuffing, said stuffed animal containing therein a batteryless read/write wireless tag/transponder configured and adapted to provide storage and retrieval of certain desired information comprising one or more of the following: animal's name, birthday, owner, points, rank, tasks completed, or places visited; and wherein said concealed tag/transponder is adapted to send and receive said information wirelessly through said outer skin or covering without damaging said skin or covering and without requiring removal of said tag/transponder.

20. The children's toy of claim 19 wherein said tag/transponder is enveloped, contained or otherwise embodied in a generally heart-shaped trinket or case or other shape or form generally representing or symbolizing the heart or life source of the stuffed animal.

* * * * *